US010906729B2

(12) United States Patent
Friel

(10) Patent No.: US 10,906,729 B2
(45) Date of Patent: Feb. 2, 2021

(54) CANISTER AND VALVE

(71) Applicant: AER BEATHA LIMITED, London (GB)

(72) Inventor: Michael Friel, London (GB)

(73) Assignee: AER BEATHA LIMITED, London (GB)

( * ) Notice: Subject to any disclaimer, the term of this patent is extended or adjusted under 35 U.S.C. 154(b) by 0 days.

(21) Appl. No.: 16/335,946

(22) PCT Filed: Sep. 21, 2017

(86) PCT No.: PCT/EP2017/073934
§ 371 (c)(1),
(2) Date: Mar. 22, 2019

(87) PCT Pub. No.: WO2018/055047
PCT Pub. Date: Mar. 29, 2018

(65) Prior Publication Data

US 2019/0315560 A1 Oct. 17, 2019

(30) Foreign Application Priority Data

Sep. 22, 2016 (GB) ..... 1616107.7

(51) Int. Cl.
*B65D 83/66* (2006.01)
*B05B 7/04* (2006.01)
(Continued)

(52) U.S. Cl.
CPC ..... *B65D 83/663* (2013.01); *B05B 7/0483* (2013.01); *B65D 83/54* (2013.01); *B65D 83/752* (2013.01)

(58) Field of Classification Search
CPC .... B65D 83/663; B65D 83/54; B65D 83/752; B05B 7/0483
See application file for complete search history.

(56) References Cited

U.S. PATENT DOCUMENTS 3,258,163 A * 6/1966 Brush ..... B67D 1/0412 222/61
3,421,698 A 1/1969 Baltzer
(Continued)

FOREIGN PATENT DOCUMENTS

BE 1002676 A4 4/1991
EP 0 349 053 A1 1/1990
(Continued)

OTHER PUBLICATIONS

Machine Translation of BE 1002676 from EPO, "espacenet.com".*
(Continued)

*Primary Examiner* — Jeremy Carroll
(74) *Attorney, Agent, or Firm* — Oliff PLC

(57) ABSTRACT

An aerosol canister for dispensing a product and propellant, and a product metering valve for use with the aerosol canister. The canister includes a high pressure chamber for containing a liquefied or compressed gas propellant, a low pressure chamber for containing a gas propellant, and a product reservoir for containing a gas propellant. A pressure regulating valve is interposed between the high pressure chamber and the low pressure chamber, the pressure regulating valve adapted to provide a fluid flow path from the high pressure chamber to the low pressure chamber when the pressure in the low pressure chamber drops below a predetermined pressure. The canister further includes a partition wall interposed between the low pressure chamber and the product reservoir.

8 Claims, 10 Drawing Sheets

(51) Int. Cl.
*B65D 83/54* (2006.01)
*B65D 83/14* (2006.01)

(56) References Cited

U.S. PATENT DOCUMENTS

| | | | | |
|---|---|---|---|---|
| 3,630,415 | A * | 12/1971 | Morane | B65D 83/752 222/129 |
| 3,995,778 | A | 12/1976 | Gamadia | |
| 4,456,155 | A * | 6/1984 | Miyata | B67D 1/0412 222/396 |
| 5,439,137 | A | 8/1995 | Grollier et al. | |
| 7,721,919 | B2 * | 5/2010 | Vanblaere | B65D 83/663 222/399 |
| 8,006,872 | B2 * | 8/2011 | Vanblaere | B65D 83/663 222/389 |
| 8,006,873 | B2 * | 8/2011 | Vanblaere | B65D 83/64 222/389 |

FOREIGN PATENT DOCUMENTS

| | | | |
|---|---|---|---|
| EP | 0 960 827 | A1 | 12/1999 |
| FR | 1 299 724 | A | 7/1962 |
| FR | 2 689 866 | A1 | 10/1993 |
| FR | 2 690 142 | A1 | 10/1993 |
| GB | 2 198 707 | A | 6/1988 |
| NL | 2006195 | C2 | 8/2012 |
| WO | 90/08075 | A1 | 7/1990 |
| WO | 90/15377 | A1 | 12/1990 |
| WO | 93/22222 | A1 | 11/1993 |
| WO | 2004/065261 | A1 | 8/2004 |
| WO | 2005/082744 | A1 | 9/2005 |
| WO | 2011/061531 | A1 | 5/2011 |
| WO | 2017/081443 | A2 | 5/2017 |

OTHER PUBLICATIONS

May 8, 2020 Examination Report issued in European Patent Application No. 17771452.4.
Apr. 19, 2017 Search Report issued in British Patent Application No. 1616107.7.
Mar. 5, 2018 International Search Report issued in International Patent Application No. PCT/EP2017/073934.
Mar. 5, 2018 Written Opinion issued in International Patent Application No. PCT/EP2017/073934.

* cited by examiner

CANISTER AND VALVE

FIELD OF THE INVENTION

The present invention relates to an aerosol canister for use in dispensing an aerosol spray of a product. In addition, the present invention relates to a metering valve which can be fitted to the canister.

BACKGROUND OF THE INVENTION

Aerosol canisters are used to deliver an aerosolised product such as an insecticide, a paint, a household product (e.g. air freshener or cleaning product) or a personal product (e.g. deodorant, antiperspirant or hairspray).

The product is typically contained in a steel or aluminium canister which is fitted at its open end with a dispensing valve. The stem of the dispensing valve is fitted with an actuator which can be depressed towards the canister to operate the valve to release the aerosolised product. The dispensing valve also comprises a dip tube which extends to the base of the canister and through which the product is carried for dispensing.

In order to force the product up the dip tube and to propel the product from the canister in the form of an aerosol, a liquid or compressed gas propellant is contained within the canister along with the product.

Current liquefied gas propellants are mainly hydrocarbons such as n-butane, iso-butane, propane and mixtures thereof. The most common propellant is a butane-propane blend (also known as liquefied petroleum gas (lpg)). These hydrocarbon propellants flash-vaporise on leaving the aerosol canister and are capable of producing very fine sprays. The hydrocarbon propellant forms a two-phase (liquid and saturated vapour) system within the canister and a dynamic equilibrium exists between the two phases giving a near constant vapour pressure irrespective of whether the canister is full or nearly empty. This means that the product can be delivered at a near constant flow rate. The main problem the current liquefied gas propellants is that they are flammable VOCs.

Less flammable compressed gas propellants such as air or nitrogen are also used but they provide little atomizing energy and thus less fine sprays. They also result in inconsistent product delivery flow rates because the pressure in the canister decreases as the product is dispensed.

Attempts have been made to improve the spray characteristics in canisters using compressed inert gases such as air and nitrogen by using a dispensing valve which introduces compressed gas into the flow through the valve stem of the dispensing valve (commonly known as a vapour tap). Such a dispensing valve is described in WO2011/061531. This dispensing valve includes a significant number of components.

There is the need to provide an improved aerosol canister that can maintain a steady flow rate even when compressed gas propellants are used. There is also a need for a simplified dispensing valve that can be used to deliver a metered dose of a product.

SUMMARY OF THE INVENTION

In a first aspect, the present invention provides an aerosol canister for dispensing a non-medicinal product, said canister comprising:

- a high pressure chamber containing a liquefied or compressed gas propellant;

- a low pressure chamber containing a non-medicinal product and vaporised propellant, the low pressure chamber having an opening for receiving a dispensing valve; and
- a pressure regulating valve interposed between the high pressure chamber and low pressure chamber, the pressure regulating valve adapted to provide a flow path from the high pressure chamber to the low pressure chamber when the pressure in the low pressure chamber drops below a predetermined pressure.

In a second aspect, the present invention provides an aerosol canister for dispensing a product, said canister comprising:

- a high pressure chamber for containing a liquefied or compressed gas propellant;
- a low pressure chamber for containing a gas propellant;
- a product reservoir for containing a product to be dispensed; and
- a pressure regulating valve interposed between the high pressure chamber and the low pressure chamber, the pressure regulating valve adapted to provide a fluid flow path from the high pressure chamber to the low pressure chamber when the pressure in the low pressure chamber drops below a predetermined pressure;
- wherein the canister further comprises a partition wall interposed between the low pressure chamber and the product reservoir.

By providing a canister which is divided into a high pressure chamber and a low pressure chamber by a pressure regulating valve, it is no longer necessary to use a flammable liquefied propellant which maintains a dynamic equilibrium between a liquid and vapour phase. It is possible to use a compressed gas propellant such as carbon dioxide, nitrogen, nitrous oxide or air which has a reduced flammability, odour and environmental impact, and easier, safer handling/transport/storage. The two chambers and pressure regulating valve ensure that the pressure in the low pressure chamber remains constant throughout the life of the canister so that a consistent delivery of the product is maintained.

Optional features of the first aspect of invention will now be set out.

In some embodiments, the aerosol canister comprises a housing for enclosing the high pressure chamber and low pressure chamber.

In some embodiments, the low pressure chamber contains a solution, suspension or emulsion of the product e.g. an aqueous or alcohol solution/suspension/emulsion of the product. The solvent used to form the solution/suspension/emulsion may be (for example) acetone, ethanol, isopropanol, a chlorinated hydrocarbon or kerosene. The nature of the solvent can selected to control the desired particle size of the aerosolized product. Ethanol is preferred for some products.

The headspace above the suspension/solution/emulsion of the product in the low pressure chamber will be filled with vaporised propellant (e.g. carbon dioxide).

The product may comprise a consumer product such as: an insecticide (e.g. a pyrethrin/pyrethroid insecticide), a household product e.g. paint, air-freshener, polish, or detergent; a personal product such as hairspray, perfume, deodorant or disinfectant.

The low pressure chamber may include a partition wall defining, on a first side of the partition wall, a propellant chamber for containing gaseous propellant and, on a second side of the partition wall, a product reservoir for containing the product. The propellant chamber is interposed between the partition wall and the pressure regulating valve.

The partition wall may have an opening for receiving the dispensing valve. The openings of the low pressure chamber and the partition wall may be axially aligned, e.g. to each receive the same dispensing valve. The openings may further be axially aligned with the pressure regulating valve.

Optional features of the second aspect of invention will now be set out.

The low pressure chamber is positioned between the partition wall and the pressure regulating valve. In this way, the low pressure chamber can receive propellant from the high pressure chamber, as is explained in more detail below.

The product reservoir may include an opening for receiving a dispensing valve. The partition wall may include an opening for receiving a dispensing valve. The openings of the partition wall and the product reservoir may be axially co-aligned, i.e. in order to receive the same dispensing valve.

In some embodiments, the aerosol canister comprises a housing for enclosing the high pressure chamber, low pressure chamber and product reservoir.

In some embodiments, the low pressure chamber may contain only propellant (i.e. substantially no product), preferably only vaporised propellant. The product reservoir may contain only product (i.e. substantially no propellant). The product reservoir may contain a solution, suspension or emulsion of the product e.g. an aqueous or alcohol solution/suspension/emulsion of the product. The solvent used to form the solution/suspension/emulsion may be (for example) acetone, ethanol, isopropanol, a chlorinated hydrocarbon or kerosene. The nature of the solvent can selected to control the desired particle size of the aerosolized product. Ethanol is preferred for some products.

The product may comprise a consumer product such as: an insecticide (e.g. a pyrethrin/pyrethroid insecticide), a household product e.g. paint, air-freshener, polish, or detergent; a personal product such as hairspray, perfume, deodorant or disinfectant.

Alternatively, the product may be a medicinal product, e.g. an inhalable drug. The inhalable drug may comprise a bronchodilator such as a beta-agonist (e.g. salbutamol, terbutaline, fenoterol), a long-acting beta-agonist (e.g. salmeterol, formoterol) or an anti-cholinergic (such as ipratropium bromide, tiotropium bromide). The inhalable drug may comprise an anti-inflammatory drug such as a steroid (e.g. beclomethasone, budesonide, ciclesonide, fluticasone, triamcinolone) or a cromoglycate drug (e.g. sodium cromoglycate, nedocromil sodium). The inhalable drug my comprise a vaccine, insulin, antibiotics, antifungals, antibacterials, anaesthetics, pulmonary surfactants or pain medications.

Optional features of the first and second aspects will now be set out.

The high pressure chamber may be external to the low pressure chamber. For example, the low pressure chamber may be separate from the high pressure chamber. In some embodiments, the high pressure chamber and/or the low pressure chamber each comprises a respective connection element for connection to the pressure regulating valve which is interposed between the two chambers. This allows the low pressure to be manufactured separately from the high pressure chamber.

The connection element may be a screw-, snap-, push or interference-fit connection.

In other embodiments, the high and/or low pressure chamber may be integral with the pressure regulating valve.

In some embodiments, the pressure regulating valve is provided at an upper end of the high pressure chamber. In this case, the high pressure chamber connection element may be provided at the upper end of the high pressure chamber. The opening in the low pressure chamber for receiving the metering valve may thus be provided at an upper end of the low pressure chamber. The opening provides a path from the low pressure chamber to atmospheric pressure. In some such embodiments, the pressure regulating valve is provided at a lower end of the low pressure chamber. In this case, the low pressure chamber connection element may be provided at the lower end of the low pressure chamber. The pressure regulating valve may be interposed between (and optionally integral with) the upper end of the high pressure chamber and the lower end of the low pressure chamber. This provides a canister having an elongated profile similar to the profile of known aerosol canisters.

In other embodiments (e.g. where the canister is used in an inverted configuration), the pressure regulating valve is provided at a lower end of the high pressure chamber. In this case, a high pressure chamber connection element may be provided at the lower end of the high pressure chamber. The pressure regulating valve may be provided at an upper end of the low pressure chamber. In this case, the low pressure chamber connection element may be provided at the upper end of the low pressure chamber. In some embodiments, the pressure regulating valve is interposed between (and optionally integral with) the lower end of the high pressure chamber and upper end of the low pressure chamber. This provides a canister having an elongated profile similar to the profile of known aerosol canisters.

In some embodiments, the pressure regulating valve is a mechanical valve i.e. it is operative in response to a change in force on its components as a result of a drop in pressure in the low pressure chamber rather than in response to any electrical signal.

In some embodiments, the pressure regulating valve is a demand valve such as that used in SCUBA dive apparatus. Such a valve can be sourced from Beswick Engineering (USA).

The pressure regulating valve may be forced towards a closed position, in which there is no fluid flow path between the high pressure chamber and the low pressure chamber, when the pressure in the low pressure chamber is at the predetermined pressure. In other words, the fluid flow-path between the high pressure chamber and the low-pressure chamber is closed when the low pressure chamber is at the predetermined pressure.

When the low pressure chamber drops below the predetermined pressure, e.g. due to propellant being dispensed from the low-pressure chamber, the pressure regulating valve may be forced into an open position (i.e. by the fluid pressure in the high pressure chamber), in which there is a fluid flow path from the high pressure chamber to the low pressure chamber. In other words, the fluid flow-path between the high pressure chamber and the low pressure chamber is opened.

In the open position, liquefied or compressed gas propellant from the high pressure chamber flows into the low pressure chamber until the pressure in the low pressure chamber matches the predetermined pressure and the pressure regulating valve is forced to close again.

Accordingly, by carefully controlling the forces exerted on the pressure regulating valve by the pressurised fluid in the high-pressure chamber and the pressurised fluid in the low-pressure chamber, the pressure regulating valve can open/close below/above the predetermined pressure.

In some embodiments, the pressure regulating valve comprises a tubular valve stem which is moveable within a valve body defined by a high pressure end wall (adjacent the high pressure chamber) and a low pressure end wall (adjacent the low pressure chamber). Each of the end walls has at least one opening for communication with the respective high pressure/low pressure chamber. The high pressure end wall of the valve body may define the upper end of the high pressure chamber. The low pressure end wall of the valve body may define the lower end of the low pressure chamber.

The tubular valve stem has a high pressure end and a low pressure end. The surface areas of the high pressure end and the low pressure end may be selected so that the pressure regulating valve closes/opens above/below the predetermined pressure. The high pressure end may have a smaller surface area than the low pressure end. Preferably, the surface area of the high pressure end and the surface area of the low pressure end are dimensioned so that the pressure regulating valve closes at the predetermined pressure.

In the closed position, the high pressure end is closed against a valve seat defined by the high pressure end wall by the pressure in the low pressure chamber such that flow from the high pressure chamber through the tubular valve stem is prevented. In the open position, a reduced pressure in the low pressure chamber forces the high pressure end away from the valve seat/high pressure end wall so that liquefied or compressed gas propellant can flow from the high pressure chamber through the tubular valve stem and into the low pressure chamber through the low pressure end wall of the valve body.

The low pressure end of the tubular valve stem may be provided with a stem flange e.g. an annular stem flange, the stem flange providing a surface upon which the pressure in the low pressure chamber can act against the fluid pressure in the high pressure chamber to force the pressure regulating valve into the closed position (with the high pressure end of the tubular valve stem held against the valve seat defined by the high pressure end wall of the valve body). In the open position, the stem flange is forced towards and may abut the low pressure end wall under the force of the resilient element.

In some embodiments, a resilient element (e.g. a coiled/helical spring) may be provided to bias the pressure regulating valve into the open position.

The spring constant of the resilient element may be selected to determine the pressure needed in the low pressure chamber to keep the pressure regulating valve in the closed position. Once the pressure in the low pressure chamber drops below this predetermined pressure (as a result of emitting the product from the canister), the resilient element forces the pressure regulating valve to open so that liquefied or compressed gas propellant from the high pressure chamber flows into the head space within the low pressure chamber until the pressure in the low pressure chamber matches the predetermined pressure and the pressure regulating valve is forced to close again.

The biasing force of the resilient element may supplement the force applied to the pressure regulating valve by the fluid in the high-pressure chamber and the fluid in the low-pressure chamber, e.g. to ensure that the pressure regulating valve closes at the predetermined pressure. For example, the resilient element may help to bias the pressure regulating valve into the open position when the low pressure chamber drops below the predetermined pressure.

In the open position, the resilient element may bias the high pressure end away from the valve seat/high pressure end wall so that liquefied or compressed gas propellant can flow from the high pressure chamber through the tubular valve stem and into the low pressure chamber through the low pressure end wall of the valve body. In the closed position, the predetermined pressure in the low pressure chamber may overcome the biasing force of the resilient element, to move the high pressure end towards the valve seat/high pressure end wall so that liquefied or compressed gas propellant cannot flow from the high pressure chamber to the low pressure chamber.

The resilient element may be affixed between the stem flange and a valve body flange (e.g. annular flange) depending from a wall of the valve body proximal the high pressure end wall. The resilient element will be compressed between the two flanges in the closed position. The resilient element (e.g. the coiled spring) may surround the tubular valve stem.

A gas permeable (liquid-impermeable) member e.g. a porous frit may be provided in the pressure regulating valve or in the low pressure chamber for at least partially blocking the opening in the low pressure end wall of the pressure regulating valve body. This helps to prevent any leakage of liquid from the low pressure chamber into the high pressure chamber, and/or vice versa.

A side wall of the valve body may comprise at least one vent (to atmosphere) between the valve body flange and the low pressure end wall to accommodate the changes in the volume defined between the hollow valve stem flange and the valve body flange. The at least one vent is positioned so that it is always on the high pressure side of the valve stem flange.

In preferred embodiments, the liquid propellant is carbon dioxide and the high pressure chamber contains liquefied carbon dioxide. The pressure within the high pressure chamber may be around 6000 kPa or 7000 kPa at 20° C., or even higher such as around 15,000 kPa. The high pressure chamber will typically have a volume of around 10-100 ml.

In this case, the high pressure chamber may be a high pressure carbon dioxide canister such as those supplied by Leland Gases (USA).

Carbon dioxide is especially preferred not only because of its reduced environmental impact compared to VOCs but also because it is readily available (e.g. as a by-product from brewing processes). Furthermore, it is an insect-attractant (and therefore ideal when the product is an insecticide).

The propellant could comprise compressed gases such as compressed air, nitrogen, nitrous oxide, oxygen, helium, argon or xenon.

The pressure within the low pressure chamber will be above atmospheric pressure. It may be around 300 kPa. It may be at a maximum pressure of around 1000 kPa. The pressure within the low pressure chamber can be selected (e.g. in combination with the solvent used to form the solution/suspension/emulsion) to provide the desired particle size of the aerolized product.

The housing may contain an opening through which a dispensing valve will extend. The housing preferably forms a seal e.g. a hermetic seal around the dispensing valve. The housing may comprise a cylindrical housing and may be formed, for example, from aluminium or steel. The housing may comprise a valve to allow venting to atmosphere of any air expelled from the pressure regulating valve i.e. during changes in the volume between the hollow valve stem flange and the valve body flange.

In some embodiments (especially when the product is an insecticide or air freshener), the canister may comprise an automatic actuator for automatically dispensing the product. The automatic actuator may be of the known type e.g. configured to automatically dispense the product at a regular time interval and/or upon detection of motion in the vicinity of the canister.

The dispensing valve may be of the known type e.g. such as that manufactured by Bespak or Salvalco.

In other embodiments the canister may have a dispensing valve for dispensing a metered dose. This is increasingly desirable where the product is an insecticide since insecticides are becoming increasingly potent. The dispensing valve may be a metering valve according to the third or fourth aspect described below.

In a third aspect, the present invention comprises a metering valve for dispensing a metered dose of product from a canister containing the product and a propellant, the valve including:

- a metering valve body comprising a propellant metering chamber and a product metering chamber; and
- a metering valve stem housed within the metering valve body and having a dispensing nozzle at a first axial end extending from the product metering chamber, an opposing second axial end portion of the metering valve stem extending from the propellant metering chamber, wherein the metering valve stem comprises:

- a product channel extending axially within the metering valve stem; and
- a propellant channel extending axially within the metering valve stem, wherein the metering valve stem is movable within the metering valve body to a dispensing position in which:

- there is no fluid communication between the product channel and the product metering chamber;
- there is no fluid communication between the propellant channel and the propellant metering chamber; and
- the propellant metering chamber and product metering chamber are in fluid communication with atmosphere via the dispensing nozzle of the metering valve stem such that a metered dose of product and propellant can be dispensed from the metering valve body.

By providing a metering valve having a metering valve body with a separate propellant metering chamber and product metering chamber which are fluid communication with atmosphere via the dispensing nozzle, it is possible to provide a consistent ratio of product and propellant exiting the metering valve body (and thus the canister) such that the control of the particle size of the aerosolised product is optimised.

Optional features of the third aspect will now be set out.

In some embodiments, the metering valve stem is movable within the metering valve body between the dispensing position and at least one filling position in which:

- the product channel and the product metering chamber are in fluid communication and/or the propellant channel and the propellant metering chamber are in fluid communication such that, in use, product can enter the product metering chamber through the metering valve stem via the product channel and/or propellant can enter the propellant metering chamber through the metering valve stem via the propellant channel;
- there is no fluid communication between the propellant metering chamber and the product metering chamber; and
- there is no fluid communication between the metering valve body and atmosphere.

In the filling position(s), the propellant and product metering chambers fill with the propellant and product respectively through the metering valve stem in preparation for dispensing to atmosphere from both chambers in the dispensing position via the dispensing nozzle.

In some embodiments, the metering valve stem is biased towards the at least one filling position by a resilient member such as a coiled spring. The resilient member may be provided in the product metering chamber or the propellant metering chamber. It may surround the metering valve stem in the product/propellant metering chamber.

In some embodiments, the propellant metering chamber and product metering chamber are in fluid communication with one another (and atmosphere via the dispensing nozzle) in the dispensing position. For example, the propellant metering chamber may be in fluid communication with the dispensing nozzle via the product metering chamber. In this way, the propellant and product can be dispensed simultaneously.

In some embodiments the propellant metering chamber may be tubular e.g. cylindrical. The propellant metering chamber may be sized to hold a predetermined quantity of propellant suitable to deliver a single dose of product. The propellant metering chamber may have a volume of between 1000 and 10000 microlitres.

In some embodiments the product metering chamber may be tubular, e.g. cylindrical. The product metering chamber may be sized to hold a predetermined quantity of product. The product metering chamber may have a volume of between 10 and 100 microlitres, e.g. between 25 and 100 microlitres.

Preferably the relative volume ratio of the product metering chamber to the propellant metering chamber is about 1:100.

The metering valve body may comprise a first axial end wall, an intermediate wall and a second axial end wall with the product metering chamber being defined by the first axial end wall and intermediate wall and the propellant metering chamber being defined by the intermediate end wall and the second axial end wall. The intermediate wall may be provided with a tubular occluding wall extending axially within the product metering chamber and encircling the dispense nozzle, the occluding wall comprising at least one radial aperture to allow fluid communication between the connecting channel and the product metering chamber in the dispensing position.

The first axial end wall may comprise a first metering valve stem hole for receiving the dispensing nozzle of the metering valve stem, the dispensing nozzle extending from the valve body through the first axial end wall of the valve body.

The intermediate wall may comprise an intermediate metering valve stem hole for receiving the metering valve stem.

The intermediate wall may be a double wall (the intermediate valve stem hole extending through both wall portions) i.e. there could be an intermediate chamber spacing the product metering chamber and the propellant metering chamber.

The second axial end wall may comprise a second metering valve stem hole for receiving the second axial end portion of the metering valve stem, the second axial end portion of the metering valve stem extending from the valve body through the second axial end wall of the valve body.

The metering valve stem holes are dimensioned to form a seal around the metering valve stem to prevent leakage of propellant/product through the valve stem holes. The metering valve stem holes may each comprise a respective gasket for assisting sealing around the metering valve stem.

The metering valve stem extends within the propellant metering chamber and product metering chamber from the dispensing nozzle at its first axial end which extends from the product metering chamber (i.e. the first axial end portion of the metering valve stem is external to the metering valve body) to the second axial end portion which extends from the propellant metering chamber (i.e. the second axial end portion of the metering valve stem is external to the metering valve body).

The metering valve stem is preferably substantially cylindrical.

In some embodiments, the product channel extends axially within the metering valve stem between a product outlet at a first axial end of the product channel and a product inlet at a second axial end of the product channel in the second axial end portion of the metering valve stem.

In the dispensing position, the fluid communication between the product channel and the product metering chamber may be prevented by isolation of the product channel/product outlet from the product metering chamber. The isolation of the product channel/outlet from the product metering chamber may be achieved by occlusion of the product channel e.g. by occlusion of the product outlet or by location of the product outlet within the propellant metering chamber in the dispensing position.

The product outlet may be a radial opening i.e. in a side wall of the metering valve stem.

In the dispensing position, the (radial) product outlet may be aligned with (and occluded by) the intermediate wall of the valve body i.e. the product outlet may be positioned within the intermediate metering valve stem hole. In other embodiments, the product outlet may be positioned within the propellant metering chamber in the dispensing position.

The product inlet is provided (outside of the metering valve body) in the second axial end portion of the metering stem valve. The product inlet may be an axial opening i.e. provided in the axial end face of the second axial end portion of the metering valve stem. The axial product inlet may be provided off-set from the centre of the axial end face of the second axial end portion of the metering valve stem.

The product channel is preferably a tubular conduit which extends axially through the metering valve stem (within the propellant metering chamber) from the (e.g. axial) product inlet to the (e.g. radial) product outlet. The axial extension of the product channel is greater than the axial extension of the propellant metering chamber.

In the filling position, fluid communication is provided between the product channel and the product metering chamber such that, in use, product can enter the product metering chamber through the metering valve stem from within the canister via the product channel.

In the filling position, the product channel/product outlet is un-occluded and the product outlet is positioned within the product metering chamber.

The metering valve stem may further comprise a tubular extension (e.g. a flexible tubular extension) fitted to the second axial end portion e.g. connected at the axial end face of the second axial end portion. The tubular extension is in fluid communication with the product channel.

In some embodiments, the propellant channel may be a tubular conduit extending axially within the metering valve stem between a propellant outlet opening at a first axial end of the propellant channel and a propellant inlet opening at a second axial end of the channel in the second axial end portion of the metering valve stem.

In other embodiments, the propellant channel may be a groove/recess extending axially along the metering valve stem between a propellant outlet end and a propellant inlet end, the propellant inlet end being provided in the second axial end portion of the metering valve stem.

In the dispensing position, the fluid communication between the propellant channel and the propellant metering chamber may be prevented by isolation of the propellant channel (e.g. isolation of the propellant outlet opening/end) from the propellant metering chamber. This may be achieved by occlusion of the propellant channel e.g. occlusion of the propellant outlet opening/end or by positioning of the propellant outlet opening/end outside of the propellant metering chamber (and the metering valve body).

The propellant outlet opening may be a radial opening i.e. in a side wall of the metering valve stem. The propellant outlet opening/end may be occluded by the second axial end wall of the valve body in the dispensing position. For example, the propellant outlet opening/end may be positioned within the second metering valve stem hole in the second axial end wall of the valve body in the dispensing position.

The propellant inlet opening/end is provided (outside of the metering valve body) in the second axial end portion of the metering stem valve. The propellant inlet opening may be a radial opening i.e. provided in a side wall of the second axial end portion of the metering valve stem. The propellant inlet opening/end will be provided closer to the axial end face of the second axial end portion of the metering valve stem than the propellant outlet opening/end. The propellant inlet opening/end will be provided further from the axial end face of the second axial end portion of the metering valve stem than the product inlet (of the product channel).

The propellant channel extends axially through/along the metering valve stem from the propellant inlet opening/end to the propellant outlet opening/end. The axial extension of the propellant channel is less than the axial extension of the propellant metering chamber and less than the axial extension of the propellant channel.

The propellant channel extends axially within/along the metering valve stem parallel and adjacent to a portion of the product channel.

In the filling position, fluid communication is provided between the propellant channel and the propellant metering chamber such that, in use, propellant can enter the propellant metering chamber through/via the metering valve stem from within the canister via the propellant channel. In the filling position, the propellant outlet opening/end is positioned within the propellant metering chamber whilst the propellant inlet opening/end remains external to the propellant metering chamber/metering valve body.

The metering valve stem may further comprise a propellant metering chamber flange (e.g. annular flange) or protrusion extending within the propellant metering chamber. The propellant metering chamber flange/protrusion acts to limit axial movement of the metering valve stem by abutment against the intermediate wall of the valve body (on the propellant metering chamber side) in the filling position. In the filling position, it also helps to seal the intermediate metering valve stem hole in the intermediate wall of the valve body (on the propellant metering chamber side) thus helping to prevent fluid communication between the propellant metering chamber and the product metering chamber. The propellant metering chamber flange/protrusion may also provide a seat for the resilient member. The resilient member may be retained within the propellant metering chamber between the propellant metering chamber flange and the second axial end wall of the valve body.

The metering valve stem may further include an axially extending connecting channel which fluidly connects the propellant metering chamber to the product metering chamber when the metering valve stem is in the dispensing position.

In some embodiments, the connecting channel may be a tubular conduit extending axially within the metering valve stem between a radial inlet opening and a radial outlet opening (both provided in the side wall of the metering valve stem).

In other embodiments, the connecting channel may be a groove/recess extending axially along the metering valve stem between an inlet end and an outlet end.

In the dispensing position, the inlet opening/end of the connecting channel is positioned within propellant metering chamber and the outlet opening/end of the connecting channel is positioned within the product metering chamber.

In the filling position, the connecting channel e.g. the inlet opening/end of the connecting channel is isolated from the propellant metering chamber e.g. aligned with (and occluded by) the intermediate wall of the valve body i.e. the inlet opening/end of the connecting channel may be positioned within the intermediate metering valve stem hole. In other embodiments, in the filling position, the inlet opening/end of the connecting channel positioned within the product metering chamber thus isolating it from the propellant metering chamber.

In some embodiments, a portion of the connecting channel may extend parallel to and adjacent the product channel. The product outlet may be radially aligned with the connecting channel. In some embodiments, the product outlet is aligned with a central axial end portion of the connecting channel i.e. the product outlet may be radially interposed between the inlet opening/end and outlet opening/end of the connecting channel. In other embodiments, the product outlet is radially aligned with the inlet opening/end of the connecting channel.

The metering valve stem may further comprise a product metering chamber flange (e.g. annular flange) or protrusion extending within the product metering chamber. The product metering chamber flange/protrusion acts to limit axial movement of the metering valve stem by abutment against the first axial end wall of the valve body in the filling position. In the filling position, it also helps to seal the first metering valve stem hole in the first axial end wall of the valve body thus helping to prevent fluid communication between the product metering chamber and the dispensing nozzle/atmosphere. The product metering chamber flange/protrusion may also provide a seat for the resilient member. The resilient member may be retained within the product metering chamber between the product metering chamber flange and the intermediate wall of the valve body.

The connecting channel is provided on/through the metering valve stem interposed between the product metering chamber flange and the propellant metering chamber flange. The product outlet is provided on the metering valve stem interposed between the product metering chamber flange and the propellant metering chamber flange In some embodiments, the dispensing nozzle is a hollow tube having a side port and an axial end port. In the filling position, both the side port and axial end port are isolated from the product metering chamber such that there is no fluid communication between the product metering chamber and the dispense nozzle.

In some embodiments, both the side port and axial end port are located externally of the product metering chamber/metering valve body in the filling position. In these embodiments, the side port is closer to the axial end port than the product metering chamber flange i.e. the spacing between the side port and the axial end port is less than the spacing between the product metering chamber flange and the axial end port.

In other embodiments, the side port is occluded in the filling position. In these embodiments, the intermediate wall may be provided with an occluding wall extending axially within the product metering chamber, the occluding wall being aligned with the side port in the filling position such that the side port is occluded. The occluding wall may be a fully or partially tubular wall e.g. fully or partially encircling the dispense nozzle/metering valve stem within the product metering chamber. The occluding wall may be separate from or integral with the intermediate wall. The occluding wall comprises at least one radial aperture.

In these embodiments, the side port is further from the axial end port than the product metering chamber flange i.e. the spacing between the side port and the axial end port is greater than the spacing between the product flange and the axial end port. In other words, the product metering chamber flange is interposed between the axial and side ports.

In the dispensing position, the side port is located within the product metering chamber such that there is fluid communication between the product metering chamber and the axial end port of the dispense nozzle (which vents to atmosphere). Where the metering valve is provided with an occluding wall in the product metering chamber, the side port is aligned with one of the at least one radial apertures in the occluding wall in the dispensing position such that product from the product metering chamber (and propellant carried from the propellant metering chamber via the connecting channel) can enter the dispense nozzle via the radial aperture in the occluding wall.

The height/axial extension of the occluding wall may be selected such that the product metering chamber flange/protrusion abuts the occluding wall in the dispensing position.

Where the metering valve is provided with a occluding wall in the product metering chamber and the occluding wall encircles the metering valve stem at the location of the outlet opening/end of the connecting channel, the occluding wall is provided with at least one further radial aperture to allow fluid communication between the connecting channel and the product metering chamber in the dispensing position.

The side port of the dispense nozzle and the outlet opening/end of the connecting channel may be diametrically opposed on the metering valve stem. In this case, where an occluding wall is provided, the occluding wall may be a tubular occluding wall encircling the metering valve stem and having opposing radial apertures. The radial apertures may be diametrically opposed.

To summarise, in preferred embodiments, in the filling position:

- the product channel/product outlet opening is un-occluded and is in fluid communication with the product metering chamber such that product flows through the product channel to fill the product metering chamber;
- the propellant channel/propellant outlet opening/end is un-occluded and is in fluid communication with the propellant metering chamber such that propellant flows through the propellant channel to fill the propellant metering chamber;
- the first metering valve stem hole in the first axial end wall of the valve body is blocked/sealed by the dispensing nozzle and by abutment of the product metering chamber flange/protrusion against the first axial end wall of the valve body;

the intermediate metering valve stem hole in the intermediate wall of the valve body is blocked/sealed by the metering valve stem and by abutment of the propellant metering chamber flange/protrusion against the intermediate wall of the valve body (on the propellant metering chamber side);

the inlet opening/end of the connecting channel is isolated from the propellant metering chamber e.g. as a result of occlusion by the intermediate wall of the valve body or by being positioned within the product metering chamber such that there is no flow of propellant from the propellant metering chamber through the channel; and the side port of the dispensing nozzle is isolated from the product metering chamber e.g. by being positioned outside the product metering chamber (outside the metering valve body) or as a result of occlusion by the occluding wall such that there is no flow of product/propellant through the dispensing nozzle.

In the dispensing position, the metering valve stem moves into the metering valve body such that, in preferred embodiments:

the product channel/product outlet is isolated from the product metering chamber e.g. as a result of occlusion by the intermediate wall of the valve body or by positioning within the propellant metering chamber;

the propellant channel/propellant outlet opening/end is occluded or isolated from the propellant metering chamber;

the first metering valve stem hole in the first axial end wall of the valve body is blocked/sealed by the dispensing nozzle but the product metering chamber flange/protrusion is unseated from the first axial end wall of the valve body (and may abut the occluding wall if present);

the propellant metering chamber flange/protrusion is unseated from the intermediate wall of the valve body (on the propellant metering chamber side);

the inlet opening/end of the connecting channel is positioned within the propellant metering chamber such that there is flow of propellant from the propellant metering chamber through the channel into the product metering chamber; and the side port of the dispensing nozzle is within the product metering chamber (within the metering valve body) and un-occluded such that there is flow of product/propellant through the dispensing nozzle to atmosphere via the axial end port.

In a fourth aspect, the present invention comprises a metering valve for dispensing a metered dose of product, the valve including:

a metering valve body comprising a propellant metering chamber with a propellant inlet and a product metering chamber with a product inlet; and a metering valve stem with a dispensing nozzle, a propellant inlet plug and a product inlet plug, wherein the metering valve stem is movable within the metering valve body to a dispensing position in which:

the propellant inlet is sealed by the propellant inlet plug and the product inlet is sealed by the product inlet plug; and the propellant metering chamber and product metering chamber are in fluid communication with atmosphere via the dispensing nozzle, such that a metered dose of product and propellant can be dispensed from the canister;

wherein the product inlet is positioned between an outlet of the dispensing nozzle and the product metering chamber.

By providing a metering valve having a metering valve body with separate propellant and product metering chambers which are fluid communication with atmosphere via the dispensing nozzle, it is possible to provide a consistent ratio of product and propellant exiting the metering valve body (and thus the canister) such that the control of the particle size of the aerosolised product is optimised.

Moreover, by providing the inlet between the outlet of the dispensing nozzle and the product metering chamber, the product metering chamber can fill by gravity when the metering valve is in the upright configuration, e.g. when the dispensing nozzle is positioned above the product metering chamber. The product reservoir therefore doesn't have to be maintained under pressure.

Optional features of the fourth aspect will now be set out.

The propellant metering chamber and product metering chamber may be cylindrical, e.g. as prescribed by a cylindrical outer surface of the metering valve. The propellant metering chamber may be sized to hold a predetermined quantity of propellant suitable to deliver a single dose of product. For example, the product metering chamber may have a volume of between 10 and 50 microlitres. Preferably the relative volume ratio of the product metering chamber to the propellant metering chamber is about 1:100. Thus, the propellant metering chamber may have a volume of between 1000 and 5000 microlitres.

The propellant inlet plug and product inlet plug may each comprise an O-ring for sealing the product inlet and the propellant inlet. The product inlet plug may be provided between the propellant inlet plug and the dispensing nozzle.

The propellant metering chamber and product metering chamber may be in fluid communication with one another in the dispensing position. In this way, the propellant and product can be dispensed simultaneously.

The metering valve stem may be movable within the metering valve body between the dispensing position and at least one filling position in which: at least one of the propellant and product inlets are open such that, in use, propellant can enter the propellant metering chamber via the propellant inlet and/or product can enter the product metering chamber via the product inlet; fluid communication is prevented between the propellant metering chamber and the product metering chamber; and fluid communication is prevented between the metering valve body and atmosphere.

The metering valve stem may be biased towards the at least one filling position by a resilient member, e.g. coiled spring. The resilient member may be provided in the product metering chamber or the propellant metering chamber. It may surround the metering valve stem in the product/propellant metering chamber.

In the filling position, both of the propellant and product inlets may be open such that, in use, propellant can enter the propellant metering chamber via the propellant inlet and product can enter the product metering chamber via the product inlet.

The metering valve stem extends within the propellant metering chamber and product metering chamber from the propellant inlet plug at its first axial end (within the propellant metering chamber) to the dispensing nozzle at its second axial end (adjacent the product metering chamber). The product inlet plug is interposed between the propellant inlet plug and the dispensing nozzle.

The metering valve may be cylindrical. For example, the metering valve body and the metering valve stem may each be substantially cylindrical, with the diameter of the metering valve stem being less than that of the metering valve body. Accordingly, the metering valve stem fits within the metering valve body.

The propellant metering chamber and product metering chamber may be separated by a interposing wall of the metering valve body, e.g. interposed between the propellant metering chamber and the product metering chamber. The interposing wall may comprise a stem hole for receiving the metering valve stem. The stem hole may be dimensioned to form a seal around the metering stem. E.g. an outer surface of the metering valve stem may sealingly engage an inner surface of the interposing wall, e.g. sealingly engage the stem hole. The stem hole may comprise a gasket for assisting sealing around the metering valve stem.

The dispensing nozzle may fluidly connect the product metering chamber with atmosphere when the metering valve stem is in the dispensing position.

The dispensing nozzle may comprise a hollow tube having a side port and an axial end port. In the dispensing position, the side port may be located within the product metering chamber such that there is fluid communication between the product metering chamber and the axial end port of the dispense nozzle. In the filling position, both the side port and axial end port of the dispensing nozzle may be isolated form the product metering chamber such that there is no fluid communication between the product metering chamber and the dispensing nozzle. For example, the side port may be occluded, e.g. by an O-ring, in the filling position.

The metering valve stem may further comprise a connecting channel which fluidly connects the propellant metering chamber to the product metering chamber when the metering valve stem is in the dispensing position. The connecting channel has an exit in the product metering chamber.

The connecting channel may be occluded in the filling position, e.g. preventing fluid communication between the product metering chamber and the propellant metering chamber Accordingly, in the dispensing position the propellant metering chamber may be in fluid communication with atmosphere via the connecting channel, product metering chamber, and dispensing nozzle.

The connecting channel may extend axially within a portion of the metering valve stem between a radial inlet opening (e.g. for communication with the propellant metering chamber) and a radial outlet opening (e.g. for communication with the product metering chamber). At least one of the radial inlet opening, and the radial outlet opening, is occluded in the filling position.

In the filling position, the radial inlet opening is isolated from the propellant metering chamber, e.g. by at least one O-ring, so that there is no fluid communication between the propellant metering chamber and the product metering chamber.

The propellant inlet may be positioned at a first axial end of the metering valve body, distal from the outlet of the dispensing nozzle.

The propellant inlet may be provided at a first axial end of the propellant metering chamber. The interposing wall may be provided at a second (opposing) axial end of the propellant metering chamber. The propellant inlet and the stem hole of the interposing wall may be axially co-aligned.

In the filling position propellant may enter the propellant metering chamber through the propellant inlet. In the dispensing position, the propellant inlet is sealed by the propellant inlet plug of the metering valve stem.

The product metering chamber comprises a product inlet. The product inlet may comprise a product opening at a first axial end of the product metering chamber for fluid communication with at least one side channel in the metering valve body. The product metering chamber may further comprise the stem hole/interposing wall at a second, opposing axial end. The product opening and stem hole may be axially co-aligned.

The product inlet may comprise the product opening and the at least one side channel.

In some embodiments, the first axial end of the product metering chamber may include a dispensing nozzle hole, e.g. for receiving the dispensing nozzle of the metering valve stem. A gap may be provided between an outer surface of the dispensing nozzle, and the dispensing nozzle hole. This gap may provide a product opening for fluid communication with the at least one side channel.

In the filling position, product may enter the product metering chamber through the product inlet. In the dispensing position, the product inlet is sealed by the product inlet plug, e.g. O-ring. The product inlet plug may seal the product inlet at the interface between the product opening and the product channel. In other words, the product channel may be occluded/sealed in the dispensing position.

Preferably, the product opening, propellant inlet and stem hole are all axially co-aligned.

In a fifth aspect, the present invention comprises a product dispenser, the product dispenser comprising a canister according to the first aspect fitted with a metering valve according to the third aspect. The metering valve may be fitted to the opening of the canister. The metering valve body may sealingly engage the opening. The metering valve may be attached to the canister, e.g. by cold welding the body of the metering valve to the opening.

Further optional features of the fifth aspect will now be set out.

The metering valve may be provided in the low pressure chamber.

The metering valve is provided in the low pressure chamber with the propellant metering chamber in fluid communication with the headspace containing vaporised propellant (e.g. vaporised carbon dioxide) and the product metering chamber in fluid communication with the product.

The second end portion of the metering valve stem may extend through the head space with the product inlet being positioned within the product. Alternatively, the tubular extension fitted to the axial end face of the second axial end portion of the metering valve stem may have an axial length sufficient to extend from the axial end face of the second axial end portion to proximal the lower end wall of the low pressure chamber.

The propellant inlet opening/end will be positioned within the headspace in the low pressure chamber.

In a sixth aspect, the present invention comprises a product dispenser, the product dispenser comprising a canister according to the second aspect fitted with a metering valve according to the fourth aspect. The metering valve may be fitted to the openings of the partition wall and the product reservoir. The metering valve body may sealingly engage the openings. The metering valve may be attached to the canister, e.g. by cold welding the body of the metering valve to the openings.

Further optional features of the sixth aspect will now be set out.

Preferably, the propellant inlet of the metering valve is in fluid communication with the propellant chamber of the canister, and the product inlet of the metering valve is in fluid communication with the product reservoir of the canister (in the filling position, at least).

The low pressure chamber and the product reservoir may be fluidly isolated from each other. The product reservoir may be fluidly isolated from the pressure regulating valve. Accordingly, the product reservoir may be filled with product at a base pressure. The predetermined pressure may be higher than the base pressure.

BRIEF DESCRIPTION OF THE DRAWINGS

Embodiments of the invention will now be described by way of example with reference to the accompanying drawings in which.

DETAILED DESCRIPTION AND FURTHER OPTIONAL FEATURES OF THE INVENTION

Figure 1:
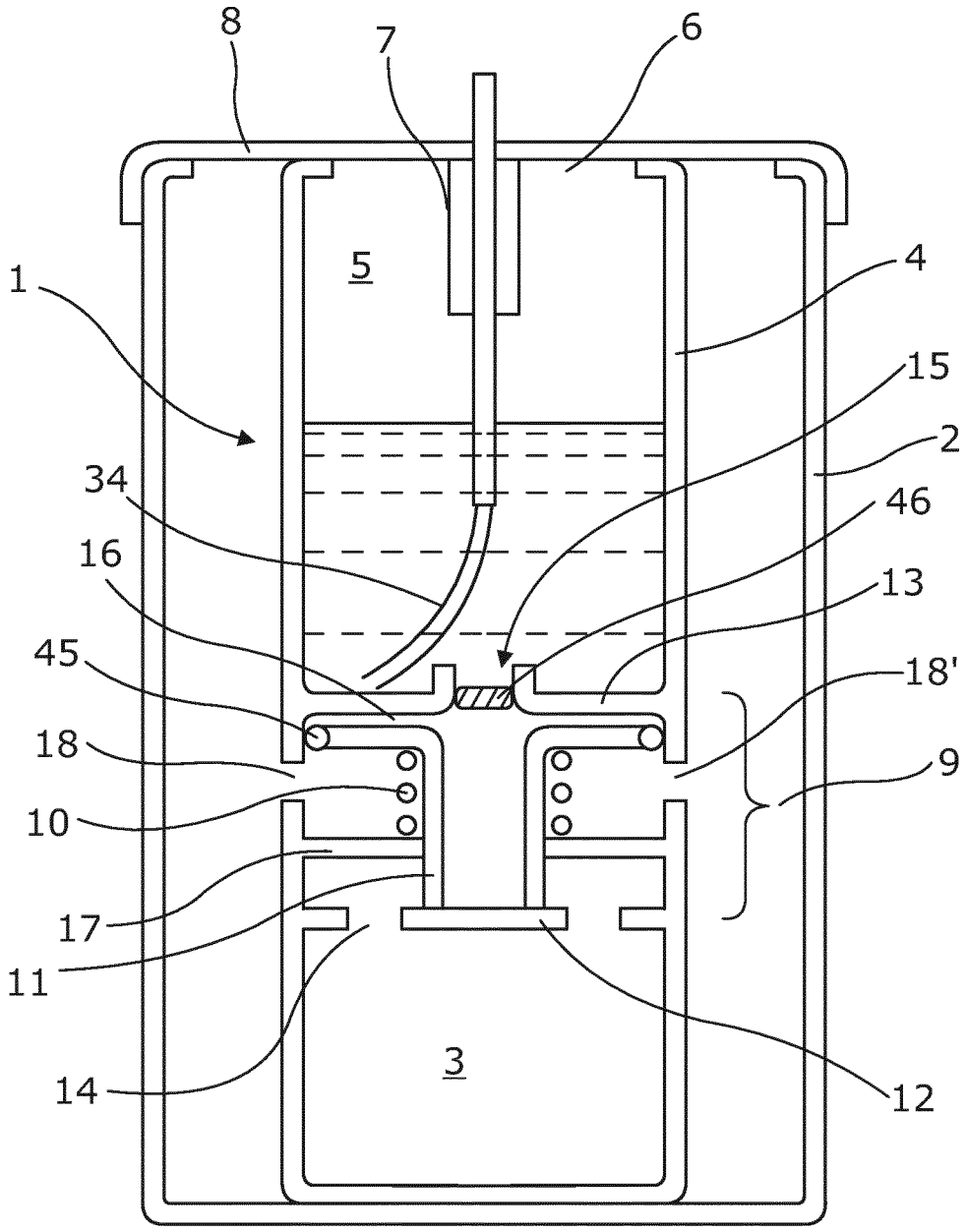
FIG. 1 shows a first embodiment of an aerosol canister with the pressure regulating valve in the closed position.
Figure 2:
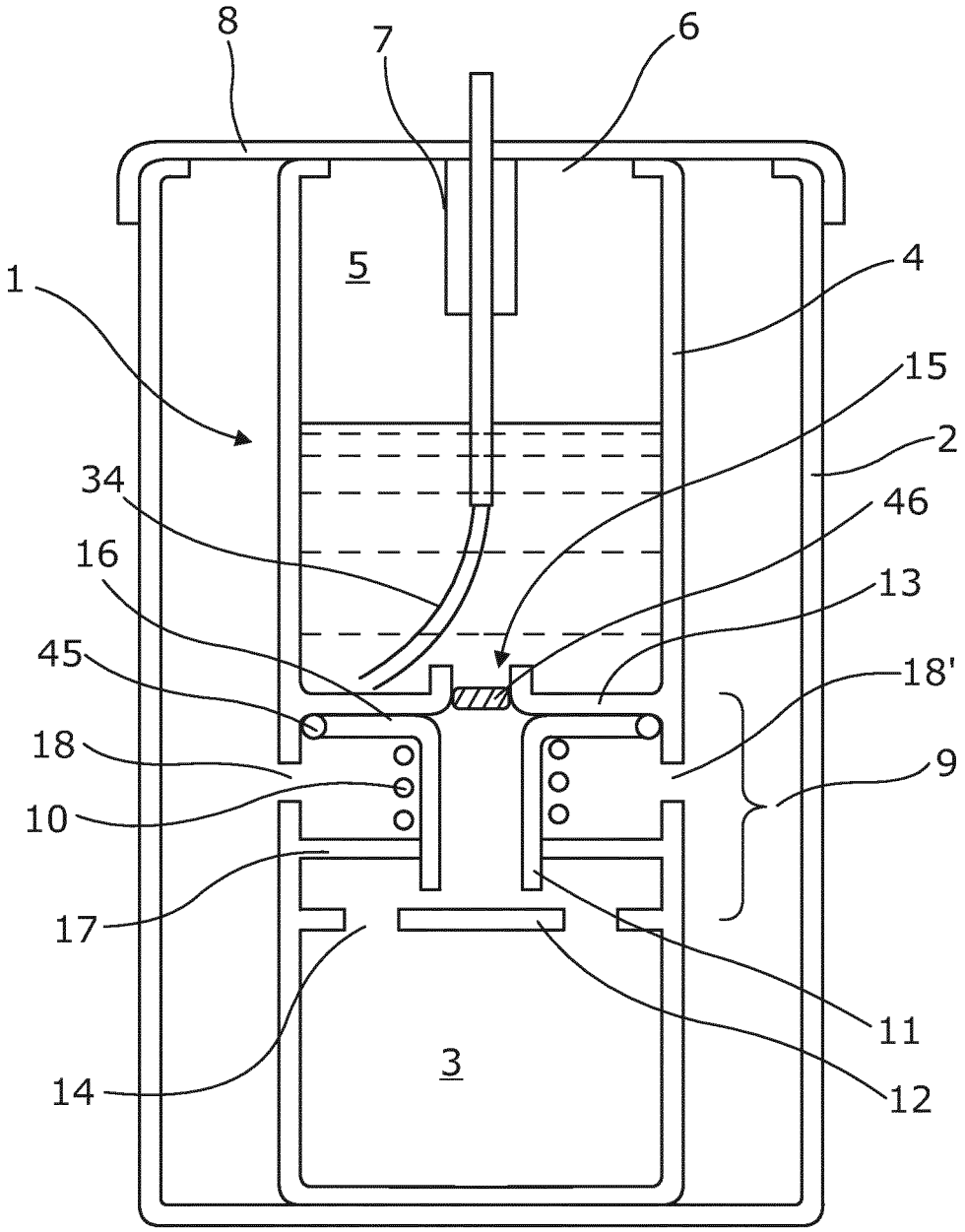
FIG. 2 shows the first embodiment with the pressure regulating valve in the open position.

FIGS. 1 and 2 show an aerosol canister 1 contained within an aluminium housing 2.

The canister 1 comprises a high pressure chamber 3 which is a high pressure carbon dioxide canister containing around 16 g (12 g-100 g) liquefied carbon dioxide. Such a high pressure carbon dioxide canister may be obtained from Leland Gases (USA). The pressure within the high pressure chamber 3 is around 6000-7000 kPa.

The canister 1 further comprises a low pressure chamber 4 containing:

a) a pyrethrin or pyrethroid (Type I or II) insecticide and synergist (such as piperonyl butoxide or N-octyl bi-cycloheptane dicarboximide dissolved/suspended or emulsified in ethanol;

b) a personal deodorant formulation dissolved/suspended or emulsified in ethanol; or c) an air freshener formulation dissolved/suspended or emulsified in ethanol.

The headspace 5 within the low pressure chamber 4 contains gaseous carbon dioxide. The target predetermined pressure within the low pressure chamber 5 is above atmospheric pressure and around 300 kPa.

The low pressure chamber 4 has an opening 6 at its upper end for receiving a metering valve 7. The metering valve is shown in more detail in FIGS. 3 and 4. The canister 1 sealed within the housing 2 by a lid portion 8 of the housing 2.

The low pressure chamber 4 can be filled with the product before crimping of the metering valve 7 or it can be filled through the metering valve 7. Both options are current practice. A porous frit 46 is provided to seal the product within the low pressure valve prior to connection to the high pressure chamber.

The canister 1 further comprises a pressure regulating valve 9 interposed between the high pressure chamber 3 and low pressure chamber 4.

The low pressure chamber 4 is primed with carbon dioxide to fill the head space 5 after connection of the pressure regulating valve 9 and the high pressure chamber 3.

The pressure regulating valve 9 is adapted to provide a flow path from the high pressure chamber 3 to the low pressure chamber 4 when the pressure in the low pressure chamber 4 drops below a predetermined pressure.

By providing a canister 1 which is divided into a high pressure chamber 4 and a low pressure chamber 3 by a pressure regulating valve 9, it is possible to use a propellant such as carbon dioxide which has a reduced environmental impact compared to the currently used VOCs. The two chambers 3, 4 and pressure regulating valve 9 ensure that the pressure in the low pressure chamber 4 remains constant throughout the life of the canister 1 so that a consistent flow of product (e.g. insecticide, air freshener or deodorant) is maintained as discussed below.

The pressure regulating valve 9 is interposed between an upper end of the high pressure chamber 3 and a lower end of the low pressure chamber 4. This provides a canister 1 having an elongated profile similar to the profile of known aerosol canisters.

The pressure regulating valve 9 is a mechanical valve i.e. it is operative in response to a change in force on its components as a result of a drop in pressure in the low pressure chamber rather than in response to any electrical signal.

The pressure regulating valve 9 is similar to a demand valve such as that used in SCUBA dive apparatus.

The pressure regulating valve 9 is forced towards an open position (shown in FIG. 2) in which there is a flow path from the high pressure chamber 3 to the low pressure chamber 5, when the pressure in the low-pressure chamber falls below a predetermined pressure value.

The pressure regulating valve 9 is forced into a closed position when the pressure in the low pressure chamber 4 is at (or above) the predetermined pressure (shown in FIG. 1). As discussed below, the dimensions of the pressure regulating valve are carefully selected to achieve movement of the valve at the predetermined pressure.

In some optional embodiments, a spring 10 may be provided to apply bias to the pressure regulating valve. The spring 10 is pictured in FIGS. 1 and 2. But as will become clear below, the spring is not necessary. The spring constant of the coiled spring 10 can be selected to control the predetermined pressure in the low-pressure chamber at which the pressure regulating valve 9 moves to the closed position.

Once the pressure in the low pressure chamber 4 drops below the predetermined pressure (as a result of emitting a dose of the insecticide from the canister 1), the pressure regulating valve 9 is forced to open by the carbon dioxide pressure in the high-pressure chamber (and optionally also by a spring, as discussed above) so that liquefied carbon dioxide from the high pressure chamber 5 flows into and vaporises within the head space 5 within the low pressure chamber 4 until the pressure in the low pressure chamber 4 matches the predetermined pressure once more and the pressure regulating valve 9 is forced to close.

The pressure regulating valve 9 comprises a tubular valve stem 11 which is moveable within a valve body defined by a high pressure end wall 12 and a low pressure end wall 13. Each of the end walls 12, 13 has at least one opening 14, 15 for communication with the respective high pressure/low pressure chamber 3, 4. The opening 15 in the low pressure end wall 13 is sealed by a porous frit 46 which is permeable to gas (carbon dioxide) but not to the product solution/suspension/emulsion.

The tubular valve stem 11 has a high pressure end and a low pressure end.

In the closed position shown in FIG. 1, the high pressure end is sealed against a valve seat defined by the high pressure end wall 12 by the pressure in the low pressure chamber 4 such that flow from the high pressure chamber 3 through the tubular valve stem 11 is prevented.

In the open position shown in FIG. 2, the drop in pressure in the low pressure chamber 4 arising from actuation of the canister, allows the high pressure end to move away from the valve seat/high pressure end wall 12 (due to the pressure in the high-pressure chamber) so that liquefied carbon dioxide can flow from the high pressure chamber 3 through the tubular valve stem 11 and into the low pressure chamber 4 through the opening 15 in the low pressure end wall 13 of the valve body.

This increases the pressure within the low pressure chamber 4 until the pressure regulating valve 9 is forced back to the closed position once the predetermined pressure is reached.

The low pressure end of the tubular valve stem 11 is provided with an annular stem flange 16 with a seal or gasket 45 around its outer peripheral edge. The stem flange 16 provides a surface upon which the pressure in the low pressure chamber 4 can act to force the pressure regulating valve 9 into the closed position shown in FIG. 1 (with the high pressure end of the tubular valve stem 11 held against the valve seat defined by the high pressure end wall 12 of the valve body).

The stem flange 16 gives the low pressure end of the stem 11 a larger surface area than the high-pressure end of the stem 11. This is crucial for operation of the pressure regulating valve. By carefully selecting the surface area of the low pressure end of the stem (i.e. the area of the stem flange), the force F=PA (where F=force, P=pressure, and A=area) applied to the low-pressure end by the carbon dioxide propellant in the low-pressure chamber will cause the valve to close only when the predetermined pressure is reached in the low-pressure chamber (i.e. by the low pressure chamber filling with propellant from the high-pressure chamber).

For example, if the high-pressure chamber has a pressure of 6000 kPa, and the predetermined/target pressure in the low pressure chamber is 300 kPa, then the area of the stem flange 16 at the low-pressure end of the stem should be 20× larger than the surface area of the high-pressure end of the stem 11. Accordingly, as soon as the pressure in the low-pressure chamber rises above 300 kPa, the carbon dioxide in the low-pressure chamber will exert a force on the stem flange 16 that is larger than the force exerted on the high-pressure end of the stem 11 by the carbon dioxide in the high-pressure chamber. The pressure regulating valve is thereby forced into the closed position.

Once the pressure in the low-pressure chamber drops back below 300 kPa, e.g. by dispensing insecticide product from the canister, then the annular stem flange 16 is forced towards and abuts the low pressure end wall 13 as shown in FIG. 2. The pressure regulating valve is thus forced back into the open position.

Where a coiled spring 10 is provided to supplement the forces exerted by the carbon dioxide in the high and low pressure chambers, it is affixed between the stem flange 16 and an annular valve body flange 17 depending from a side wall of the valve body proximal the high pressure end wall 12. The coiled spring 10 is compressed between the two flanges 16, 17 in the closed position shown in FIG. 1. The coiled spring 10 surrounds the tubular valve stem 11.

The side walls of the valve body comprise vents 18, 18' (to atmosphere) between the valve body flange 17 and the low pressure end wall 13 to accommodate the changes in the volume defined between the hollow valve stem flange 16 and the valve body flange 17 during actuation of the valve.

The vents 18, 18' are positioned so that they are always on the high pressure side of the valve stem flange 16. As the tubular valve stem 11 moves to the open position, air will be drawn through the vents 18, 18'. As the tubular valve stem 11 moves to the closed position, air will be pushed out through the vents 18, 18'. These vents may not be needed in many embodiments where the movement between the open and closed positions is minimal.

As discussed above, the arrangement of the high pressure chamber 3, low pressure chamber 4 and the pressure regulating valve 9, ensures a constant pressure is maintained within the low pressure chamber 4 by flow and vaporisation of liquid carbon dioxide from the high pressure chamber 3 when the pressure in the low pressure chamber 4 drops below a predetermined pressure. This constant pressure in the low pressure chamber ensures a consistent dose of insecticide/air freshener/deodorant is delivered each time.

Figure 3:
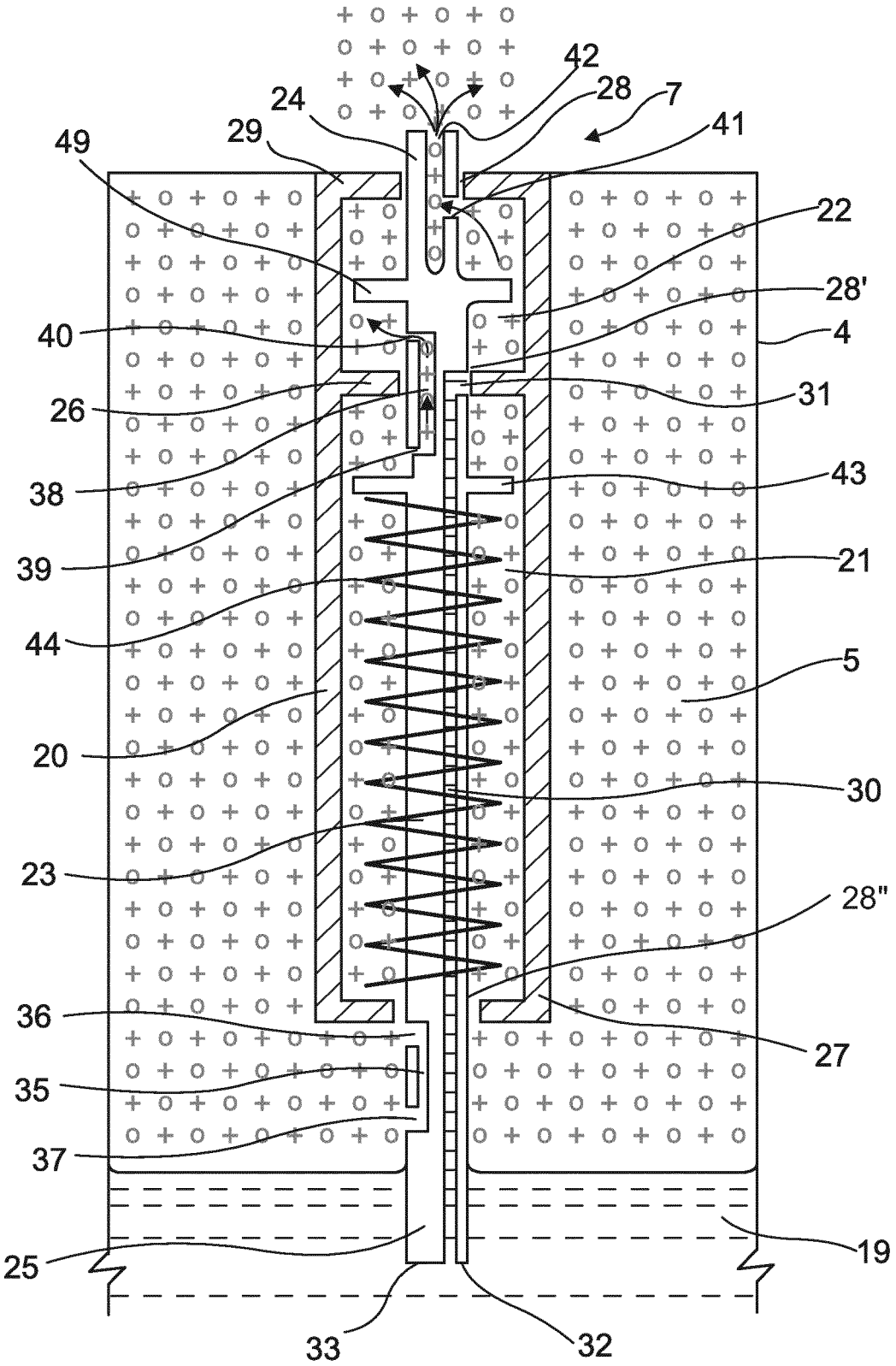
FIG. 3 shows a first embodiment of a metering valve according to the third aspect of the present invention in a dispensing position.
Figure 4:
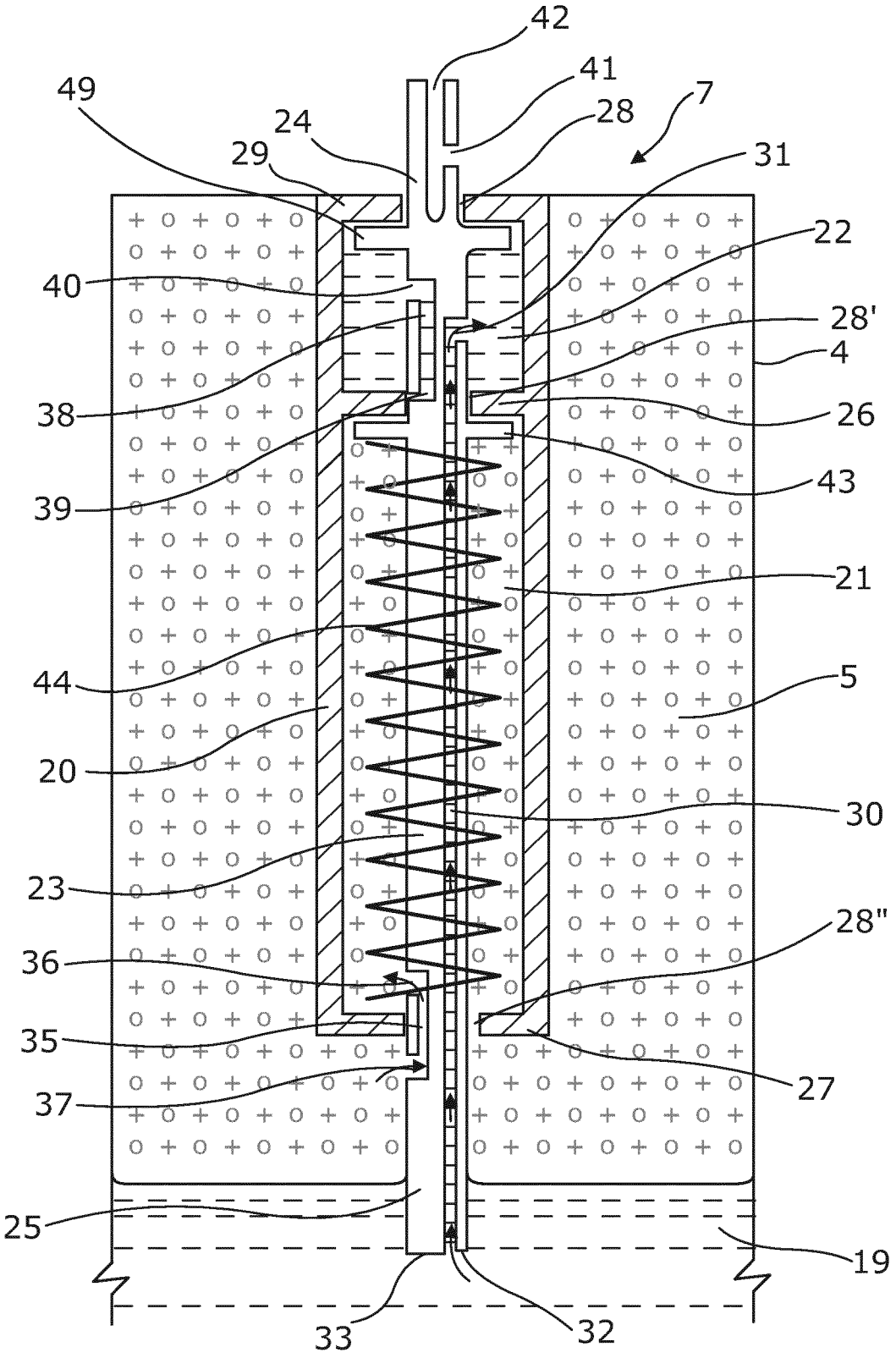
FIG. 4 shows the metering valve of FIG. 3 in a filling position.

FIGS. 3 and 4 show a cross-section through a first embodiment of a metering valve 7 according to the third aspect of the present invention.

The metering valve 7 is provided in the opening 6 of the low pressure chamber 4 of a canister 1 according to the first aspect. The low pressure chamber 4 contains an ethanolic suspension/solution/emulsion of product 19 and gaseous carbon dioxide in the headspace 5.

The metering valve 7 comprises a metering valve body 20 which is divided into a propellant metering chamber 21 and a product metering chamber 22 by an intermediate wall 26. The product metering chamber 22 is defined by the intermediate wall 26 and a first axial end wall 29 of the valve body. The propellant metering chamber 21 is defined by the intermediate wall 26 and a second axial end wall 27 of the valve body.

The metering valve 7 further comprises a cylindrical metering valve stem 23 housed within the metering valve body 20 and having a dispensing nozzle 24 at its first axial end. The dispensing nozzle 24 extends from the product metering chamber 22. The metering valve stem 23 has an opposing second axial end portion 25 extending from the propellant metering chamber 21.

The first axial end wall 29 of the valve body 20 comprises a first metering valve stem hole 28 for receiving the dispensing nozzle 24 of the metering valve stem 23, the dispensing nozzle 24 extending from the valve body 20 through the first axial end wall 29 of the valve body 20.

The intermediate wall 26 comprises an intermediate metering valve stem hole 28' for receiving the metering valve stem.

The second axial end wall 27 of the valve body 20 comprises a second metering valve stem hole 28" for receiving the second axial end portion 25 of the metering valve stem 23, the second axial end portion 25 of the metering valve stem 23 extending from the valve body 20 through the second axial end wall 27 of the valve body 20.

The metering valve stem holes 28, 28', 28" are dimensioned to form a seal around the metering valve stem 23 to prevent leakage of propellant/product through the metering valve stem holes 28, 28', 28". The metering valve stem holes 28, 28', 28" may each comprise a respective gasket or o-ring (not shown) for assisting sealing around the metering valve stem 23.

The propellant metering chamber 21 is tubular and cylindrical. The propellant metering chamber 21 is sized to hold a predetermined quantity of propellant suitable to deliver a single dose of product. The propellant metering chamber 21 may have a volume of between 1000 and 10000 microlitres e.g. around 2500 microlitres.

The product metering chamber 22 is tubular and cylindrical. It is sized to hold a predetermined quantity of insecticide. The product metering chamber 22 may have a volume of between 25 and 100 microlitres.

Preferably the relative volume ratio of the product metering chamber 22 to the propellant metering chamber 21 is about 1:100.

The metering valve stem 23 extends within the propellant metering chamber 21 and product metering chamber 22 from the dispensing nozzle 24 at its first axial end which extends from the product metering chamber 22 to the second axial end portion 25 which extends from the propellant metering chamber 21 i.e. the second axial end portion 25 of the metering valve stem 23 is external to the metering valve body 20.

The metering valve stem 23 comprises a product channel 30 extending axially within the metering valve stem 23 between a product outlet 31 at a first axial end of the product channel 30 and a product inlet 32 at a second axial end of the product channel 30 in the second axial end portion 25 of the metering valve stem 23.

The product outlet 31 is a radial opening in a side wall of the metering valve stem 23.

The product inlet 32 is provided (outside of the metering valve body 20) in the second axial end portion 25 of the metering stem valve 23. The product inlet 32 is an axial opening provided in the axial end face 33 of the second axial end portion 25 of the metering valve stem 23. The axial product inlet 32 is off-set from the centre of the axial end face 33 of the second axial end portion 25 of the metering valve stem 25.

The product channel 30 extends axially through the metering valve stem 23 (within the propellant metering chamber 21) from the axial product inlet 32 to the radial product outlet 31. The axial extension of the product channel 30 is greater than the axial extension of the propellant metering chamber 21.

The metering valve stem 23 may further comprise a tubular extension 34 (e.g. a flexible tubular extension) fitted to the second axial end portion 25 by connection at the axial end face 33 of the second axial end portion 25. This is shown in FIGS. 1 and 2. The tubular extension 34 is in fluid communication with the product channel 30.

The metering valve has a propellant channel 35 which comprises a conduit extending axially within the metering valve stem 23 between a propellant outlet opening 36 at a first axial end of the propellant channel (conduit) 35 and a propellant inlet opening 37 at a second axial end of the propellant channel (conduit) 35 in the second axial end portion 25 of the metering valve stem 23.

The propellant outlet opening 36 is a radial opening in the side wall of the metering valve stem.

The propellant inlet opening 37 is provided (outside of the metering valve body 20) in the second axial end portion 25 of the metering stem valve 23. The propellant outlet opening 36 is a radial opening provided in a side wall of the second axial end portion 25 of the metering valve stem 23. The propellant inlet opening 37 is closer to the axial end face 33 of the second axial end portion 25 of the metering valve stem 23 than the propellant outlet opening 36 (i.e. the spacing between the propellant inlet opening 37 and the axial end face 33 of the second axial end portion 25 is less than the spacing between the propellant outlet opening 36 and the axial end face 33). The propellant inlet opening 37 will be provided further from the axial end face 33 of the second axial end portion 25 of the metering valve stem 23 than the product inlet 32 (i.e. the spacing between the propellant inlet opening 37 and the axial end face 33 of the second axial end portion 25 is more than the spacing between the product inlet 32 and the axial end face 33—in this specific embodiment, the product inlet is, in fact, provided in the axial end face 33).

The propellant channel (conduit) 35 extends axially through the metering valve stem 23 from the radial propellant inlet opening 37 to the radial propellant outlet opening 36. The axial extension of the propellant channel (conduit) 35 is less than the axial extension of the propellant metering chamber 21 and less than the axial extension of the propellant channel 30.

The propellant channel (conduit) 35 extends axially within the metering valve stem 23 parallel and adjacent to a portion of the product channel 30.

The metering valve stem 23 further includes a connecting channel 38 which comprises an axially extending conduit having a radial inlet opening 39 and a radial outlet opening 40 (both provided in the side wall of the metering valve stem 23).

A portion of the connecting channel (conduit) 38 extends parallel to and adjacent the product channel 30. The product outlet 31 is radially aligned with a central axial end portion of the connecting channel (conduit) 38 i.e. the product outlet 31 is radially interposed between the inlet opening 39 and outlet opening 40 of the connecting channel (conduit) 38.

The dispensing nozzle 24 is a hollow tube having a side port 41 and an axial end port 42.

The metering valve stem 23 further comprises an annular propellant metering chamber flange 43 extending within the propellant metering chamber 21. A coiled spring 44 is retained within the propellant metering chamber 21 between the propellant metering chamber flange 43 and the second axial end wall 27 of the valve body 20. It surrounds the metering valve stem 23 in the propellant metering chamber 21.

The metering valve stem 23 further comprises an annular product metering chamber flange 49 extending within the product metering chamber 22.

The metering valve stem 23 is movable within the metering valve body 20 to a dispensing position (shown in FIG. 3) in which there is no fluid communication between the product channel 30 and the product metering chamber 22. The fluid communication between the product channel 30 and the product metering chamber 22 is prevented by occlusion of the product channel 30 which is achieved by occlusion of the product outlet 31. The radial product outlet 31 is aligned with (and occluded by) the intermediate wall 26 of valve body i.e. the product outlet 31 is positioned within the intermediate metering valve stem hole 28'.

In the dispensing position shown in FIG. 3, fluid communication between the propellant channel (conduit) 35 and the propellant metering chamber 21 is prevented. The fluid communication between the propellant channel (conduit) 35 and the propellant metering chamber 21 is prevented by isolation of the propellant channel (conduit) 35 from the propellant metering chamber 21 which is achieved by isolation of the propellant outlet opening 36 from the propellant metering chamber 21. In the dispensing position, the propellant outlet opening 36 is positioned outside of the propellant metering chamber 21 (and the metering valve body 20).

In the dispensing position shown in FIG. 3, the propellant metering chamber 21 and product metering chamber 22 are in fluid communication with atmosphere via the dispensing nozzle 24 of the metering valve stem 23 such that a metered dose of product and propellant can be dispensed from the metering valve body 20. In the dispensing position, the side port 41 of the dispensing nozzle 24 is located within the product metering chamber 22 such that there is fluid communication between the product metering chamber 22 and the axial end port 42 of the dispense nozzle 24 (which vents to atmosphere).

The connecting channel (conduit) 38 fluidly connects the propellant metering chamber 21 to the product metering chamber 22 when the metering valve stem 23 is in the dispensing position. The radial inlet opening 39 of the connecting channel (conduit) 38 is positioned within propellant metering chamber 21 and the radial outlet opening 40 of the connecting channel (conduit) 38 is positioned within the product metering chamber 22. In this way, the propellant metering chamber 21 is in fluid communication with the dispensing nozzle 24 via the product metering chamber 22 and the propellant and product can be dispensed simultaneously.

To summarise, in the dispensing position shown in FIG. 3:

- the product channel 30/product outlet 31 is occluded by the intermediate wall 26 of the valve body 20 thus preventing fluid communication between the product channel 30 and the product metering chamber 22;
- the propellant channel (conduit) 35/propellant outlet opening 36 are isolated from the propellant metering chamber 21 thus preventing fluid communication between the propellant channel (conduit) 35 and the propellant metering chamber 21;
- the first metering valve stem hole 28 in the first axial end wall 29 of the valve body is blocked/sealed by the dispensing nozzle 24 but the product metering chamber flange 49 is unseated from the first axial end wall 29 of the valve body 20;
- the propellant metering chamber flange 43 is unseated from the intermediate wall 26 of the valve body 20 (on the propellant metering chamber side);
- the inlet opening 39 of the connecting channel (conduit) 38 is positioned within the propellant metering chamber 21 such that there is flow of propellant from the propellant metering chamber 21 through the connecting channel (conduit) 38 into the product metering chamber 22; and
- the side port 41 of the dispensing nozzle 24 is within the product metering chamber 22 (within the metering valve body) such that there is flow of product/propellant through the dispensing nozzle 24 to atmosphere via the axial end port 42.

The metering valve stem 23 is movable within the metering valve body 20 between the dispensing position and a filling position (shown in FIG. 4) in which fluid communication is provided between the product channel 30 and the product metering chamber 22 so that product can enter the product metering chamber 22 through the metering valve stem 23 via the product channel 30. The product channel 30 is un-occluded and the product outlet 31 is positioned within the product metering chamber 22.

In the filling position, fluid communication is also provided between the propellant channel (conduit) 35 and the propellant metering chamber 21 so that propellant can enter the propellant metering chamber 21 through the metering valve stem 23 via the propellant channel (conduit) 35. The propellant outlet opening 36 is positioned within the propellant metering chamber 21 whilst the propellant inlet opening 37 remains external to the propellant metering chamber 21/metering valve body 20.

In the filling position, the propellant and product metering chambers 21, 22 fill with the propellant and product respectively through the metering valve stem 23 in preparation for dispensing to atmosphere from both chambers 21, 22 in the dispensing position via the dispensing nozzle 24.

In the filling position shown in FIG. 4, there is no fluid communication between the propellant metering chamber 21 and the product metering chamber 22. The radial inlet opening 39 of the connecting channel (conduit) 38 is aligned with (and occluded by) the intermediate wall 26 of the valve body 20 i.e. the inlet opening 39 of the connecting channel (conduit) 38 is positioned within the intermediate metering valve stem hole 28'.

In the filling position shown in FIG. 4, there is no fluid communication between the metering valve body 20 and atmosphere. Both the side port 41 and axial end port 42 of the dispensing nozzle 24 are located externally of the product metering chamber 22/metering valve body 20.

The propellant metering chamber flange 43 acts to limit axial movement of the metering valve stem 23 by abutment against the intermediate wall 26 on the propellant metering chamber 21 side in the filling position. It also helps to seal the intermediate metering valve stem hole 28' at the intermediate wall 26 of the valve body 20 thus helping to prevent fluid communication between the propellant metering chamber 21 and the product metering chamber 22.

The product metering chamber flange 49 acts to limit axial movement of the metering valve stem 23 by abutment against the first axial end wall 29 of the valve body 20 in the filling position. It also helps to seal the first metering valve stem hole 28 at the first axial end wall 29 of the valve body 20 thus helping to prevent fluid communication between the product metering chamber 22 and the dispensing nozzle 24/atmosphere.

To summarise, in the filling position shown in FIG. 4:

- the product channel 30/product outlet 31 are un-occluded such that product flows through the product channel 30 to fill the product metering chamber 22;
- the propellant channel (conduit) 35/propellant outlet opening 36 are in fluid communication with the propellant metering chamber 21 (with the propellant outlet opening 36 within the propellant metering chamber 21) such that propellant flows through the propellant channel (conduit) 35 to fill the propellant metering chamber 21;
- the first metering valve stem hole 28 in the first axial end wall 29 of the valve body 20 is blocked/sealed by the dispensing nozzle 24 and by abutment of the product metering chamber flange 49 against the first axial end wall 29 of the valve body 20;

the intermediate metering valve stem hole 28' in the intermediate wall 26 of the valve body 20 is blocked/sealed by the metering valve stem 23 and by abutment of the propellant metering chamber flange 43 against the intermediate wall 26 (on the propellant metering chamber side);

the inlet opening 39 of the connecting channel (conduit) 38 is occluded by the intermediate wall 26 of the valve body such that there is no flow of propellant from the propellant metering chamber 21 through the connecting channel (conduit) 38; and the side port 41 of the dispensing nozzle 24 is outside the product metering chamber 22 (outside the metering valve body 20) such that there is no flow of product/propellant through the dispensing nozzle 24.

Figure 5:
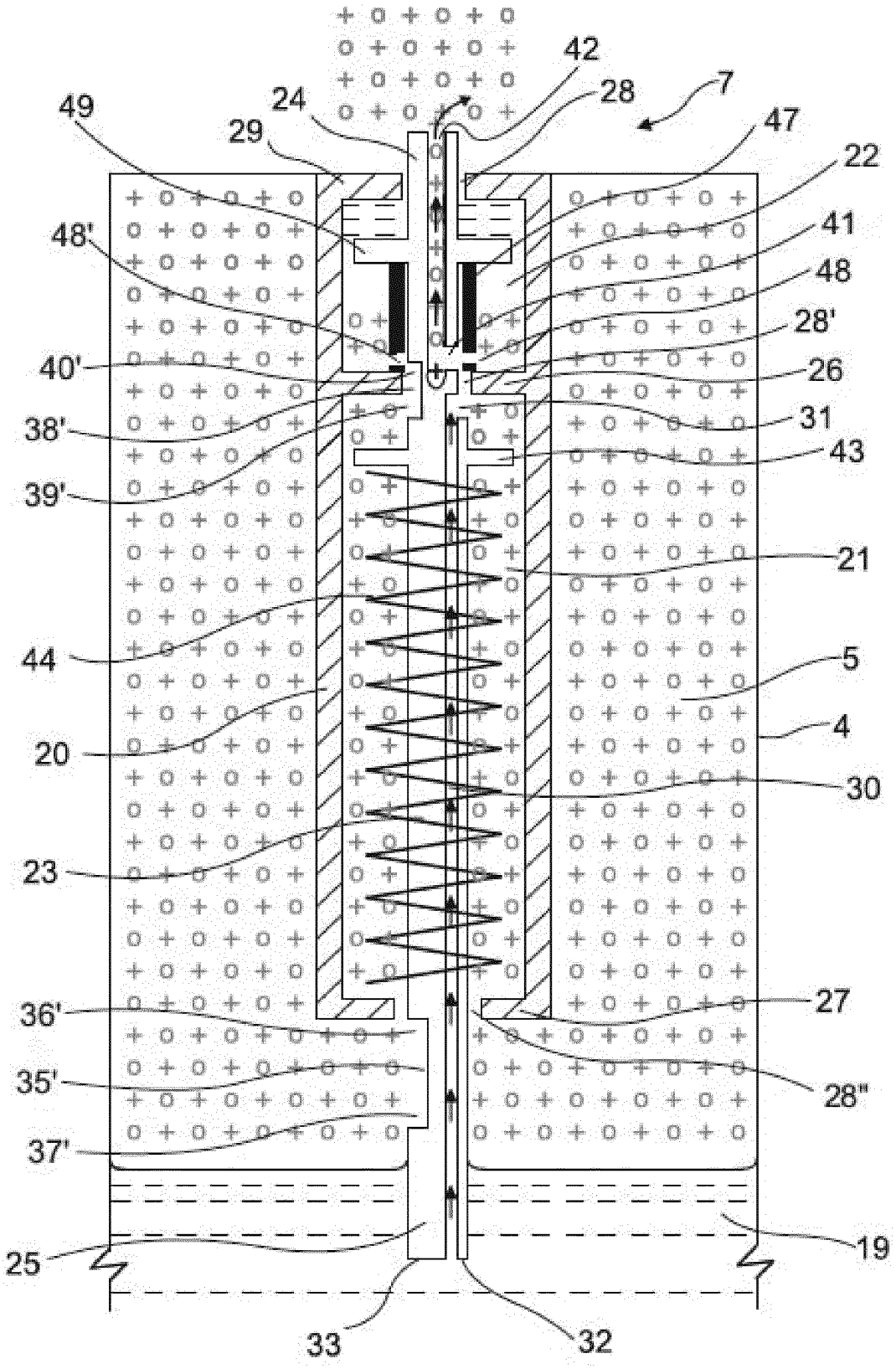
FIG. 5 shows a second embodiment of a metering valve according to the third aspect of the present invention in a dispensing position.
Figure 6:
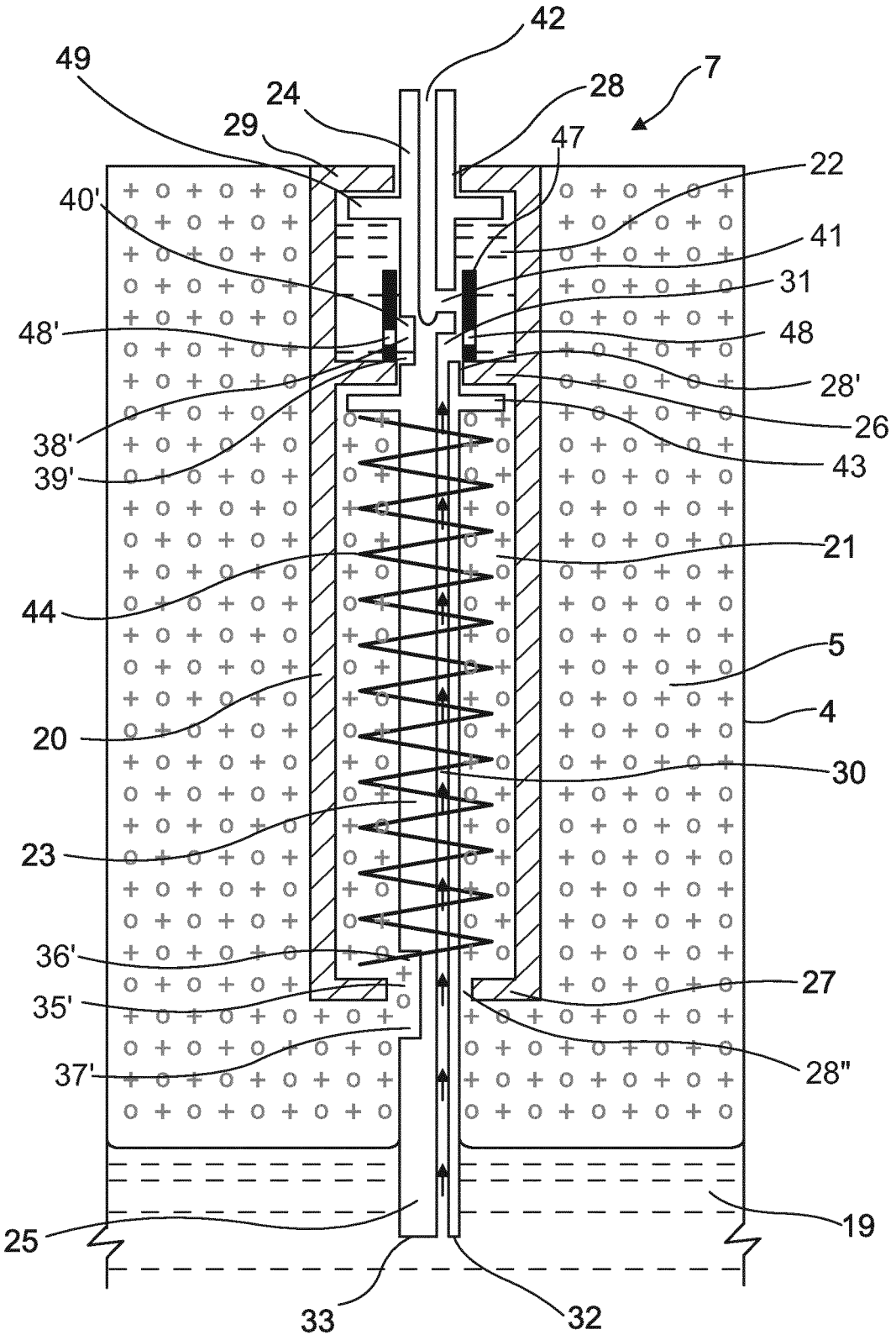
FIG. 6 shows the metering valve of FIG. 5 in a filling position.

FIGS. 5 and 6 show a cross-section through a second embodiment of a metering valve 7 according to the third aspect of the present invention.

Many features of the second embodiment of the metering valve are as described for the first embodiment shown in FIGS. 3 and 4 and therefore common reference numerals are used. Features common to both embodiments will not be described again below.

The metering valve 7 comprises a metering valve body 20 which is divided into a propellant metering chamber 21 and a product metering chamber 22 by an intermediate wall 26. The intermediate wall 26 comprises an axially extending tubular occluding wall 47 which encircles the dispensing nozzle 24 of the metering valve stem 23 in the vicinity of the side port 41. The tubular occluding wall 47 comprises a first radial aperture 48 and a diametrically opposed second radial aperture 48'.

The metering valve has a propellant channel 35' which comprises a recess extending axially along the surface of the metering valve stem 23 between a propellant outlet end 36' at a first axial end of the propellant channel (recess) 35' and a propellant inlet end 37 at a second axial end of the propellant channel (recess) 35 in the second axial end portion 25 of the metering valve stem 23.

The propellant inlet end 37' is provided (outside of the metering valve body 20) in the second axial end portion 25 of the metering stem valve 23. The propellant inlet end 37' is closer to the axial end face 33 of the second axial end portion 25 of the metering valve stem 23 than the propellant outlet end 36' (i.e. the spacing between the propellant inlet end 37' and the axial end face 33 of the second axial end portion 25 is less than the spacing between the propellant outlet end 36' and the axial end face 33). The propellant inlet end 37' will be provided further from the axial end face 33 of the second axial end portion 25 of the metering valve stem 23 than the product inlet 32 (i.e. the spacing between the propellant inlet end 37 and the axial end face 33 of the second axial end portion 25 is more than the spacing between the product inlet 32 and the axial end face 33—in this specific embodiment, the product inlet is, in fact, provided in the axial end face 33).

The propellant channel (recess) 35' extends axially along the surface of the metering valve stem 23 from the radial propellant inlet end 37' to the radial propellant outlet end 36'. The axial extension of the propellant channel (recess) 35' is less than the axial extension of the propellant metering chamber 21 and less than the axial extension of the propellant channel 30.

The propellant channel (recess) 35' extends axially along the metering valve stem 23 parallel and adjacent to a portion of the product channel 30.

The metering valve stem 23 further includes an axially extending connecting channel (recess) 38' which comprises a recess extending axially along the surface of the metering valve stem 23 between an inlet end 39' and an outlet end 40'.

The product outlet 31 is radially aligned with the connecting channel (recess) 38' and diametrically opposed to the inlet end 39' of the connecting channel (recess) 38'.

The metering valve stem 23 is movable within the metering valve body 20 to a dispensing position (shown in FIG. 5) in which there is no fluid communication between the product channel 30 and the product metering chamber 22. The fluid communication between the product channel 30 and the product metering chamber 22 is prevented by isolation of the product channel 30 from the product metering chamber 22 which is achieved by positioning of the product outlet 31 within the propellant metering chamber 21

In the dispensing position shown in FIG. 5, fluid communication between the propellant channel (recess) 35' and the propellant metering chamber 21 is prevented. The fluid communication between the propellant channel (recess) 35' and the propellant metering chamber 21 is prevented by isolation of the propellant channel (recess) 35' from the propellant metering chamber 21 which is achieved by isolation of the propellant outlet end 36' from the propellant metering chamber 21. In the dispensing position, the propellant outlet end 36' is positioned outside of the propellant metering chamber 21 (and the metering valve body 20).

In the dispensing position shown in FIG. 5, the propellant metering chamber 21 and product metering chamber 22 are in fluid communication with atmosphere via the dispensing nozzle 24 of the metering valve stem 23 such that a metered dose of product and propellant can be dispensed from the metering valve body 20. In the dispensing position, the side port 41 of the dispensing nozzle 24 is aligned with the first radial aperture 48 through the tubular occluding wall 47 such that there is fluid communication between the product metering chamber 22 and the axial end port 42 of the dispense nozzle 24 (which vents to atmosphere).

The connecting channel (recess) 38' fluidly connects the propellant metering chamber 21 to the product metering chamber 22 when the metering valve stem 23 is in the dispensing position. The inlet end 39' of the connecting channel (recess) 38' is positioned within propellant metering chamber 21 and the outlet end 40' of the connecting channel (recess) 38' is positioned within the product metering chamber 22 aligned with the second radial aperture 48' through the tubular occluding wall 47. In this way, the propellant metering chamber 21 is in fluid communication with the dispensing nozzle 24 via the product metering chamber 22 and the propellant and product can be dispensed simultaneously.

To summarise, in the dispensing position shown in FIG. 5:

the product channel 30/product outlet 31 is isolated form the product metering chamber 22 and is positioned within the propellant metering chamber 21 thus preventing fluid communication between the product channel 30 and the product metering chamber 22;

the propellant channel (recess) 35'/propellant outlet end 36' are isolated from the propellant metering chamber 21 thus preventing fluid communication between the propellant channel (recess) 35' and the propellant metering chamber 21;

the first metering valve stem hole 28 in the first axial end wall 29 of the valve body is blocked/sealed by the dispensing nozzle 24 but the product metering chamber flange 49 is unseated from the first axial end wall 29 of the valve body 20 and abuts the occluding wall 47;

the propellant metering chamber flange 43 is unseated from the intermediate wall 26 of the valve body 20 (on the propellant metering chamber side);

the inlet end 39' of the connecting channel (recess) 38' is positioned within the propellant metering chamber 21 and the outlet end 40' is aligned with the second radial aperture 48' through the occluding wall 47 such that there is flow of propellant from the propellant metering chamber 21 through the connecting channel (recess) 38' into the product metering chamber 22; and the side port 41 of the dispensing nozzle 24 is aligned with the first radial aperture 48 through the occluding wall 47 such that there is flow of product/propellant through the dispensing nozzle 24 to atmosphere via the axial end port 42.

The metering valve stem 23 is movable within the metering valve body 20 between the dispensing position and a filling position (shown in FIG. 6) in which fluid communication is provided between the product channel 30 and the product metering chamber 22 so that product can enter the product metering chamber 22 through the metering valve stem 23 via the product channel 30. The product outlet 31 positioned within the product metering chamber 22.

In the filling position, fluid communication is also provided between the propellant channel (recess) 35' and the propellant metering chamber 21 so that propellant can enter the propellant metering chamber 21 via the propellant channel (recess) 35'. The propellant outlet end 36' is positioned within the propellant metering chamber 21 whilst the propellant inlet end 37' remains external to the propellant metering chamber 21/metering valve body 20.

In the filling position, the propellant and product metering chambers 21, 22 fill with the propellant and product respectively via the metering valve stem 23 in preparation for dispensing to atmosphere from both chambers 21, 22 in the dispensing position via the dispensing nozzle 24.

In the filling position shown in FIG. 6, there is no fluid communication between the propellant metering chamber 21 and the product metering chamber 22. The inlet end 39' of the connecting channel (recess) 38' is isolated from the propellant metering chamber 21 by positioning within the product metering chamber 22 (within the occluding wall 47).

To summarise, in the filling position shown in FIG. 6:

the product channel 30/product outlet 31 are un-occluded with the product outlet aligned with the first radial aperture 48 through the occluding wall 47 within the product metering chamber 22 such that product flows through the product channel 30 to fill the product metering chamber 22;

the propellant channel (recess) 35'/propellant outlet end 36' are in fluid communication with the propellant metering chamber 21 (with the propellant outlet end 36' within the propellant metering chamber 21) such that propellant flows through the propellant channel (recess) 35' to fill the propellant metering chamber 21;

the first metering valve stem hole 28 in the first axial end wall 29 of the valve body 20 is blocked/sealed by the dispensing nozzle 24 and by abutment of the product metering chamber flange 49 against the first axial end wall 29 of the valve body 20;

the intermediate metering valve stem hole 28' in the intermediate wall 26 of the valve body 20 is blocked/sealed by the metering valve stem 23 and by abutment of the propellant metering chamber flange 43 against the intermediate wall 26 (on the propellant metering chamber side);

the inlet end 39' of the connecting channel (recess) 38' is isolated from the propellant metering chamber 21 by positioning within the product metering chamber 22 such that there is no flow of propellant from the propellant metering chamber 21 through the connecting channel (recess) 38'; and the side port 41 of the dispensing nozzle 24 is isolated from the product metering chamber 21 as a result of occlusion by the occluding wall 47 such that there is no flow of product/propellant through the dispensing nozzle 24.

Figure 7:
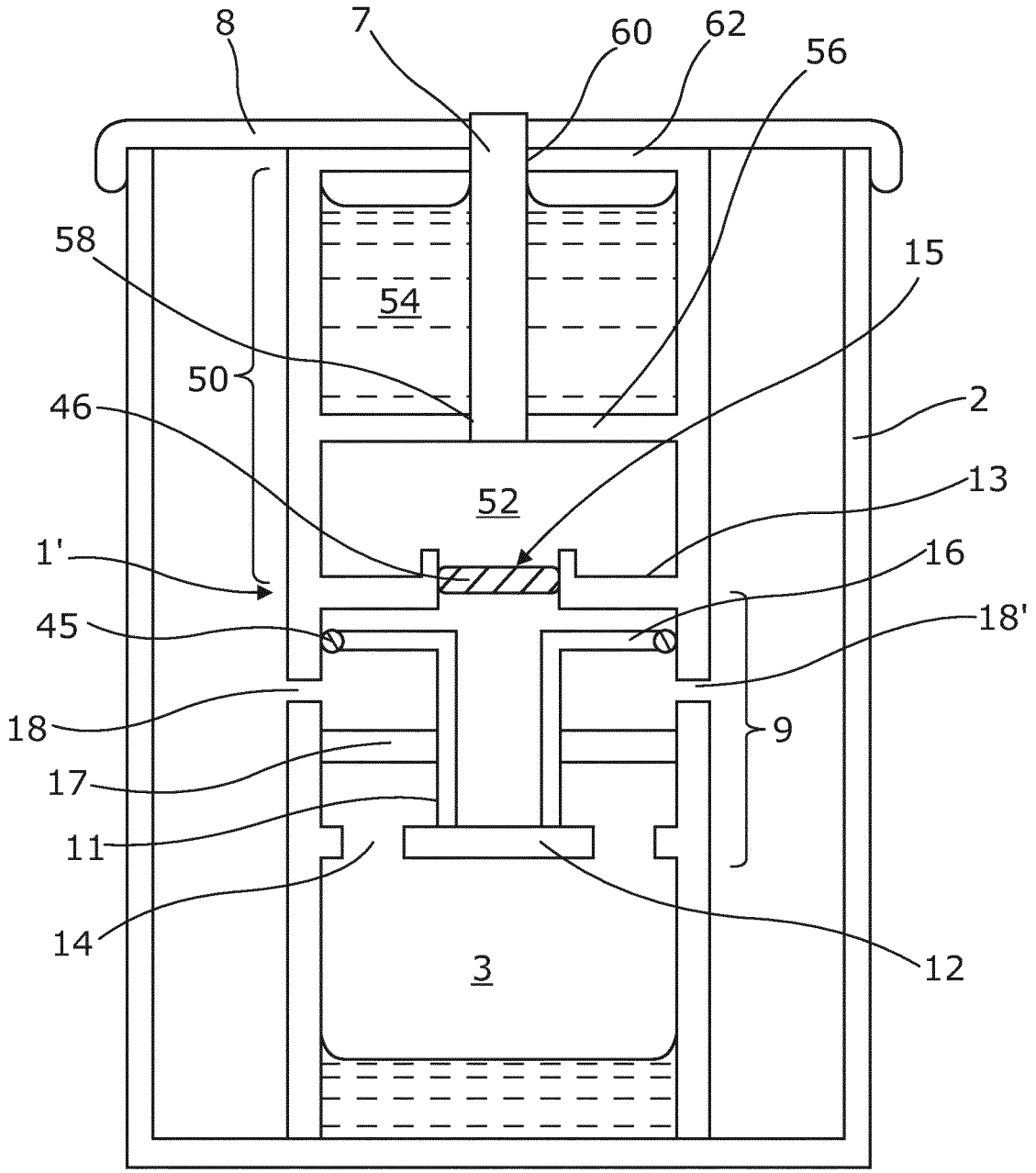
FIG. 7 shows an embodiment of a canister according to the second aspect with the pressure regulating valve in the closed position.
Figure 8:
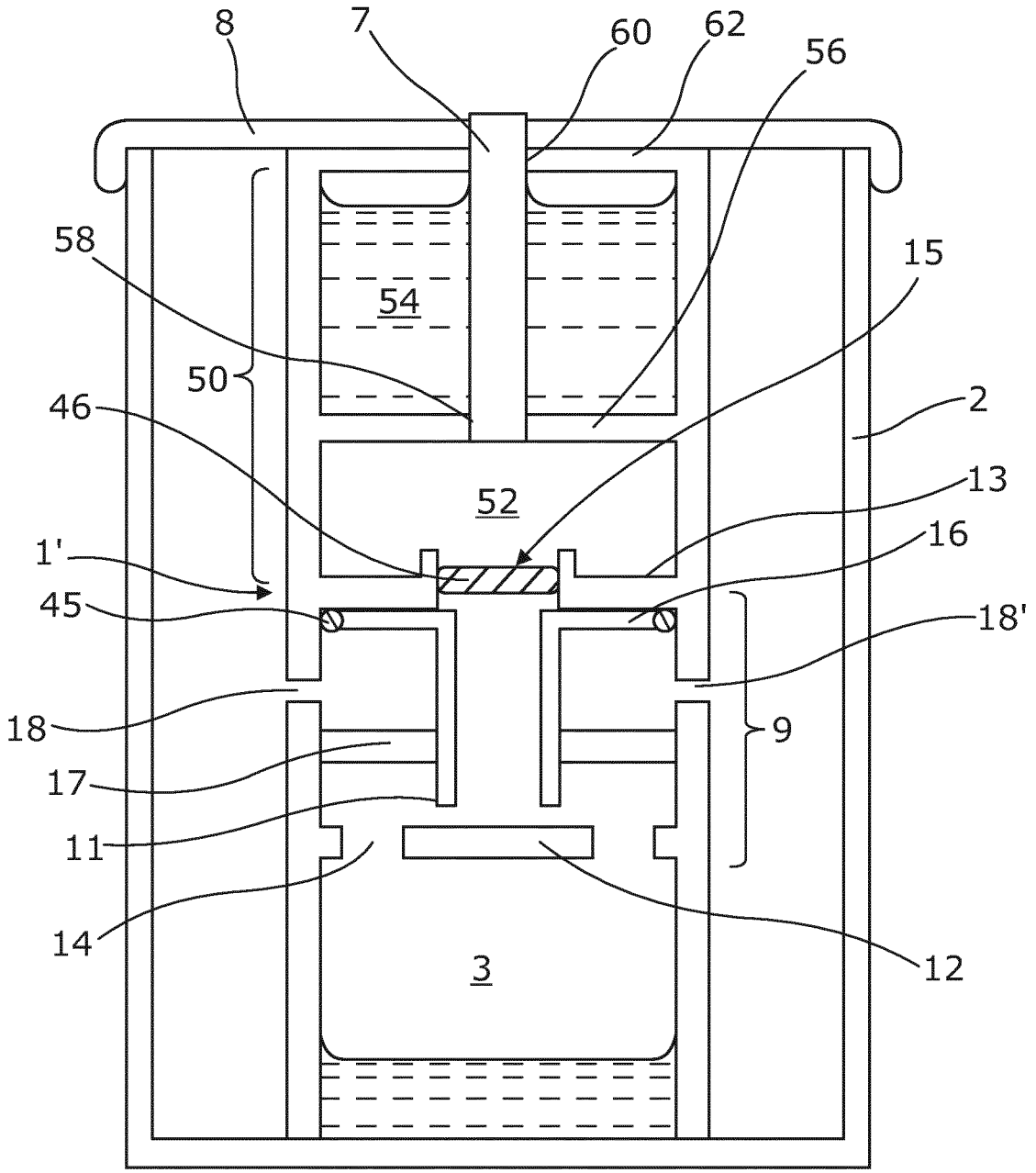
FIG. 8 shows the canister of FIG. 7 with the pressure regulating valve in the open position.

FIGS. 7 and 8 show an embodiment of a canister 1' according to the second aspect of the present invention, with the pressure regulating valve 9 in the closed and open positions respectively. Where the features of the canister of FIGS. 7 and 8 are the same as shown in the canister of FIGS. 1 and 2, the same reference numerals are used. In other words, the pressure regulating valve 9 is identical, and operates in exactly the same way, as the pressure regulating valve 9 of FIGS. 1 and 2.

However, the configuration of the low pressure side 50 of the pressure regulating valve is different, and explained below.

As shown, the low pressure side 50 of the canister 1' is split into two chambers—a low pressure chamber 52 for containing a gaseous propellant; and a product reservoir 54 for containing product, which is also at a low pressure relative to the high pressure chamber 3. In fact, the product reservoir 54 is maintained at a base pressure that is below the predetermined pressure of the low pressure chamber 52. Typically, the product in the product reservoir may be maintained at approximately atmospheric pressures.

The low pressure chamber 52 interacts with the high pressure chamber 3 in exactly the same way as the low pressure chamber 5 in FIGS. 1 and 2.

A partition wall 56 separates the low pressure chamber 52 from the product reservoir 54. In use, the canister is assembled with a dispensing valve 7. As shown, the dispensing valve 7 is received in openings 58, 60 in the partition wall 56 and upper wall 62, respectively.

The openings 58, 60 in the partition wall 56 and upper wall 62 are dimensioned to seal against an outer surface of the dispensing valve 7. Thus, the dispensing valve prevents product in the product reservoir 54 from mixing with propellant in the propellant chamber 52 of the canister 1'. This is particularly advantageous where the propellant and product are immiscible, and/or where the product and propellant are relatively unstable in combination.

The propellant and product may only come into contact with each other after they enter the dispensing valve 7 from their respective chambers 52, 54. The dispensing valve used may be a metering valve as shown in FIGS. 9 and 10.

Figure 9:
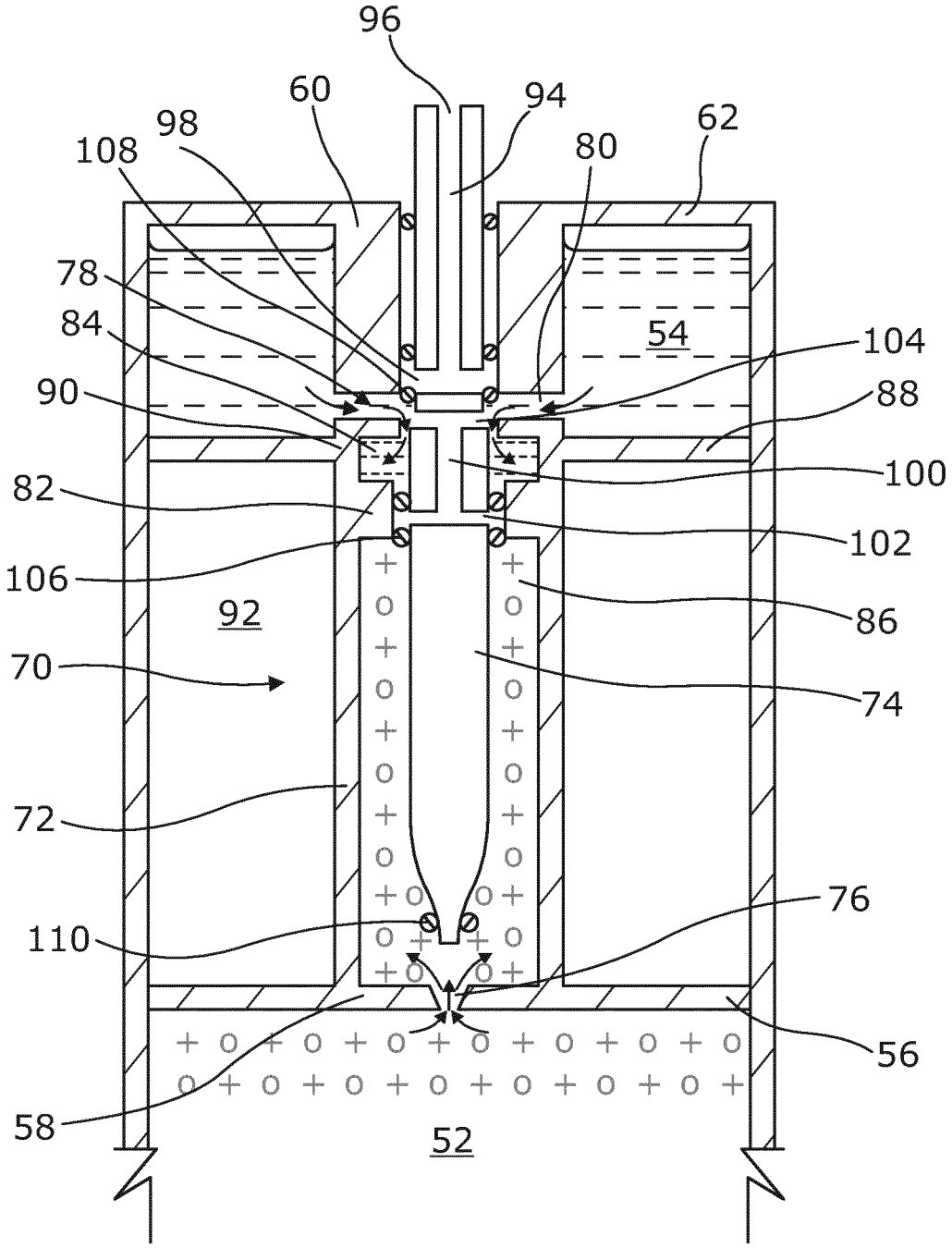
FIG. 9 shows an embodiment of a metering valve according to the fourth aspect in a filling position.
Figure 10:
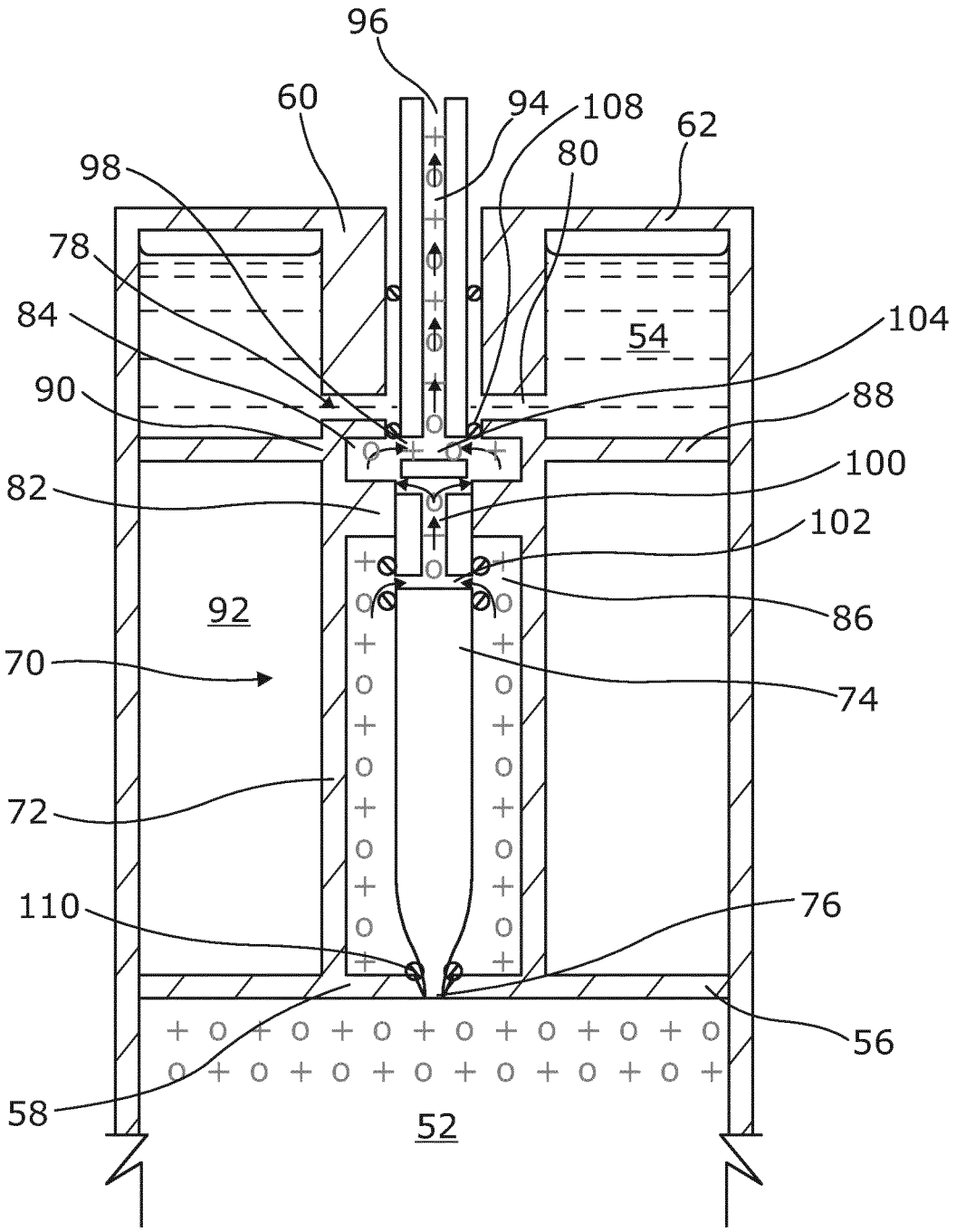
FIG. 10 shows the metering valve of FIG. 9 in a dispensing position.

FIGS. 9 and 10 show an embodiment of a metering valve according to the fourth aspect of the present invention, in a filling position and dispensing position respectively.

The metering valve stem 74 is urged into the filling position of FIG. 9 by a coiled spring (not shown). The metering valve stem 74 is movable into the dispensing position by application of a force sufficient to overcome the force of the spring, e.g. by a user depressing the dispensing nozzle 94 into the canister.

The metering valve 70 essentially comprises a cylindrical metering valve body 72, within which is fitted cylindrical metering valve stem 74.

The metering valve body 72 includes a propellant inlet 76 positioned at an axial end of the metering valve body 72, for allowing propellant to flow into propellant metering chamber 86; and a product inlet 78 for allowing product to flow into product metering chamber 84, the product inlet including a side channel 80. A separating wall 82 separates the product metering chamber 84 from a propellant metering chamber 86. Metering valve stem 74 seals against an inner surface of the separating wall 82 through provision of a gasket (not shown), such that there is substantially no space between the separating wall 82 and metering valve stem 74 through which fluid can pass.

Product inlet 78 is in fluid communication with the product reservoir 54 of FIGS. 7 and 8. Propellant inlet 76 is in fluid communication with the propellant chamber 52 of FIGS. 7 and 8. Moreover, the opening 58 of partition wall 56 seals against the metering valve body 72, and the opening 60 of the upper wall 62 also seals against the metering valve body 72.

In practice, the canister 1' and metering valve 70 are supplied to an assembly factory as separate parts. The product reservoir 54 is then filled with product simultaneously with the metering valve 70 being fitted to the canister. The metering valve 70 is cold welded to the openings 58, 60 to ensure an effective seal.

A second canister partition wall 88 of the canister, with corresponding opening 90, is shown in FIG. 9. Partition walls 56, 88 define between them an empty space 92. Second partition wall 88 is provided for reasons that will become clear below.

Metering valve stem 74 includes a dispensing nozzle/hose 94, with a side port 98 and an axial end port 96; and a connecting channel 100 with a radial inlet opening 102 and a radial outlet opening 104.

In the filling position as shown in FIG. 9, radial inlet opening 102 of the connecting channel 100 is sealed/occluded from propellant metering chamber by O-ring 106. Thus, while in the dispensing position, fluid is unable to flow between the propellant metering chamber 86 and the product metering chamber 84. Moreover, side port 98 of dispensing nozzle 94 is sealed/occluded from product reservoir 54 and product metering chamber 84 by O-ring 108. Thus, neither product, nor propellant, are able to exit the metering valve 70 in the filling position, and propellant is unable to enter the product reservoir.

In this filling position, propellant flows into the propellant metering chamber 86 from the low pressure chamber 52 via the open propellant inlet 76; and product flows into the product metering chamber 84 from the product reservoir 54, via the product inlet 78. Accordingly, the two metering chambers fill with product and propellant, to a quantity prescribed by the respective sizes of the product and propellant metering chambers.

As propellant flows into the propellant metering chamber 86, the pressure in the propellant chamber 52 will fall below the predetermined pressure. The pressure regulating valve of canister 1' will therefore open, to allow propellant to flow into the low pressure chamber 52 from the high pressure chamber 3, until the predetermined pressure is re-established in the low-pressure chamber (at which point the pressure regulating valve will close again).

In effect, a metered quantity of product and propellant is measured out by the metering valve in the filling position. In practice, the process of filling the metering chambers 84, 86 with product and propellant takes a fraction of a second.

As shown in FIG. 9, the side channel 80 of the product inlet 78 is positioned just above partition wall 88 (i.e. adjacent to the partition wall, on the same side of the partition wall as the axial outlet 96 of the dispensing nozzle 94), and the product metering chamber 84 in turn is positioned just below the side channel 80. Accordingly, even when the level of product in the product reservoir 54 runs low, product will still flow into the product metering chamber 84 under gravity when the metering valve stem 74 is in the filling position. Hence, the embodiment of FIGS. 9 and 10 are configured to be used in the upright configuration shown, and the product in the product reservoir therefore doesn't have to be maintained under pressure.

Once the product metering chamber 84 and propellant metering chamber 86 are filled with product and propellant (respectively), the metering valve can then be moved into a dispensing configuration as shown in FIG. 10, by translation of the metering valve stem 74 within the metering valve body 72.

FIG. 10 shows the metering valve in the dispensing configuration.

In the dispensing configuration, the metering valve stem 74 is pressed into the metering valve body 72 relative to the filling position, e.g. by applying a force to the dispensing nozzle 94.

In the dispensing position, a propellant inlet plug (O-ring) 110 seals/occludes the propellant inlet 76, so that propellant cannot flow between the propellant chamber 52 and the propellant metering chamber 86. Similarly, a product inlet plug (O-ring) 108 seals/occludes product inlet 78, so that product cannot flow between the product reservoir 54 and the product metering chamber 84.

Simultaneously, radial inlet 102 of connecting channel 100 is open to the propellant metering chamber 86, radial outlet 104 of the connecting channel 100 is open to the product metering chamber 84, and side port 98 of dispensing nozzle 94 is open to the product reservoir 84.

Accordingly, the propellant (which is initially at the predetermined pressure) travels into the product reservoir 84 via the connecting channel 100, continues through the product metering chamber 84 into the dispensing nozzle 94, and finally out of the axial end port 96 to atmosphere. As the propellant passes through the product metering chamber 84, it flushes the product out with it, thus causing the product to be dispensed from the dispensing nozzle under pressure.

Advantageously, the product and propellant only meet each other at the very last minute, i.e. milliseconds before they exit the dispensing nozzle. This is particularly advantageous where the propellant and product are immiscible, and/or where the product and propellant are relatively unstable in combination.

Once the product and propellant have been dispensed, the metering valve stem 74 will move back into the filling position, under the force of the coiled spring (now shown), where the product metering chamber 84 and propellant metering chamber 86 can fill once again.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the scope of the invention.

For example, the conduit propellant channel and/or the conduit connecting channel of the metering valve shown in FIGS. 3 and 4 can be replaced with the recess channels shown in FIGS. 5 and 6 (and vice versa). The dispense nozzle structure and occluding wall of the metering valve shown in FIGS. 5 and 6 can be used in the FIG. 3/4 valve (and vice versa).

The invention claimed is:

1. A metering valve for dispensing a metered dose of product, the valve including:

a metering valve body comprising a propellant metering chamber with a propellant inlet and a product metering chamber with a product inlet; and a metering valve stem with a dispensing nozzle, a propellant inlet plug and a product inlet plug, wherein the metering valve stem is movable within the metering valve body to a dispensing position in which:

the propellant inlet is sealed by the propellant inlet plug and the product inlet is sealed by the product inlet plug; and the propellant metering chamber and product metering chamber are in fluid communication with atmosphere via the dispensing nozzle, such that a metered dose of product and propellant can be dispensed from the canister;

wherein the product inlet is positioned between an outlet of the dispensing nozzle and the product metering chamber.

2. A metering valve according to claim 1 wherein the metering valve stem is movable within the metering valve body between the dispensing position and at least one filling position in which:

at least one of the propellant and product inlets are open such that, in use, propellant can enter the propellant metering chamber via the propellant inlet and/or product can enter the product metering chamber via the product inlet;

fluid communication is prevented between the propellant metering chamber and the product metering chamber; and fluid communication is prevented between the metering valve body and atmosphere.

3. A metering valve according to claim 2 wherein, in the filling position both of the propellant and product inlets are open such that, in use, propellant can enter the propellant metering chamber via the propellant inlet and product can enter the product metering chamber via the product inlet.

4. A metering valve according to claim 2, comprising an interposing wall interposed between the product metering chamber and the propellant metering chamber for separating the product metering chamber from the propellant metering chamber.

5. A metering valve according to claim 4 wherein the interposing wall comprises a stem hole for receiving the metering valve stem.

6. A metering valve according to claim 2 wherein the dispensing nozzle comprises a hollow tube having a side port and an axial end port, wherein in the filling position both the side port and axial end port are isolated from the product metering chamber such that there is no fluid communication between the product metering chamber and the dispensing nozzle.

7. A metering valve according to claim 6 wherein the side port is occluded in the dispensing position.

8. A metering valve according to claim 2 wherein the propellant inlet is positioned at a first axial end of the metering valve body, distal from the outlet of the dispensing nozzle.

* * * * *